US010144020B2

(12) United States Patent
Ophardt et al.

(10) Patent No.: US 10,144,020 B2
(45) Date of Patent: Dec. 4, 2018

(54) PUMP FOR UNDER COUNTER DISPENSING SYSTEM

(71) Applicant: OP-Hygiene IP GmbH, Niederbipp (CH)

(72) Inventors: Heiner Ophardt, Arisdorf (CH); Andrew Jones, St. Anns (CA); Valery Ten, Hannon (CA)

(73) Assignee: OP Hygiene IP GmbH, Niederbipp (CH)

( * ) Notice: Subject to any disclaimer, the term of this patent is extended or adjusted under 35 U.S.C. 154(b) by 0 days.

(21) Appl. No.: 15/709,731

(22) Filed: Sep. 20, 2017

(65) Prior Publication Data

US 2018/0078958 A1 Mar. 22, 2018

(30) Foreign Application Priority Data

Sep. 21, 2016 (CA) ..... 2942640

(51) Int. Cl.

| | |
|---|---|
| ***B05B 11/00*** | (2006.01) |
| ***A47K 5/12*** | (2006.01) |
| ***A47K 5/14*** | (2006.01) |
| ***F04B 19/06*** | (2006.01) |
| ***F04B 19/22*** | (2006.01) |
| ***F04B 23/02*** | (2006.01) |
| ***F04B 53/16*** | (2006.01) |
| ***A47K 5/16*** | (2006.01) |

(52) U.S. Cl.

CPC ..... *B05B 11/0008* (2013.01); *A47K 5/1205* (2013.01); *A47K 5/1211* (2013.01); *A47K 5/14* (2013.01); *A47K 5/16* (2013.01); *B05B 11/0054* (2013.01); *B05B 11/3015* (2013.01); *B05B 11/3087* (2013.01); *F04B 19/06* (2013.01); *F04B 19/22* (2013.01); *F04B 23/028* (2013.01); *F04B 53/162* (2013.01); *A47K 5/1217* (2013.01); *A47K 2005/1218* (2013.01)

(58) Field of Classification Search

CPC ..... B05B 11/0008; B05B 11/0054; B05B 11/3015; B05B 11/3087; A47K 5/1205; A47K 5/1211; A47K 5/14; A47K 5/16; A47K 5/1217; A47K 2005/1218; F04B 19/06; F04B 19/22; F04B 23/028; F04B 53/162

USPC ..... 222/190, 145.5–145.6, 321.7–321.9, 222/383.1

See application file for complete search history.

(56) References Cited

U.S. PATENT DOCUMENTS

| | | | | |
|---|---|---|---|---|
| 5,431,309 | A | 7/1995 | Ophardt | |
| 5,445,288 | A * | 8/1995 | Banks | B05B 7/0025 222/105 |
| 5,676,277 | A | 10/1997 | Ophardt | |
| 5,918,771 | A * | 7/1999 | van der Heijden | B05B 7/0025 222/136 |
| 6,142,342 | A | 11/2000 | Lewis | |
| 6,929,150 | B2 | 8/2005 | Muderlak et al. | |

(Continued)

*Primary Examiner* — Nicholas J Weiss
*Assistant Examiner* — Andrew P Bainbridge
(74) *Attorney, Agent, or Firm* — Thorpe North & Western, LLP

(57) ABSTRACT

A piston pump with a piston chamber-forming body and a piston-forming element relatively coaxially reciprocally movable to dispense liquid and air from a discharge outlet, which the discharge outlet is fixed relative to the piston chamber-forming body.

20 Claims, 19 Drawing Sheets

(56) References Cited

U.S. PATENT DOCUMENTS

| | | | | |
|---|---|---|---|---|
| 7,364,053 | B2 * | 4/2008 | Ophardt | A47K 5/16 137/801 |
| 8,071,933 | B2 | 12/2011 | Ophardt et al. | |
| 8,113,388 | B2 * | 2/2012 | Ophardt | G01F 11/025 222/181.3 |
| 8,245,877 | B2 | 8/2012 | Ophardt | |
| 2008/0304978 | A1 | 12/2008 | Ophardt et al. | |
| 2009/0166381 | A1 * | 7/2009 | Phelps | A47K 5/12 222/180 |
| 2010/0140300 | A1 * | 6/2010 | Lewis | A47K 5/1205 222/321.3 |
| 2015/0320266 | A1 * | 11/2015 | Creaghan | B05B 7/0037 222/190 |

* cited by examiner

PUMP FOR UNDER COUNTER DISPENSING SYSTEM

SCOPE OF THE INVENTION

The present invention relates generally to piston pumps and, more particularly, to a piston pump assembly for use in an under counter dispensing system.

BACKGROUND OF THE INVENTION

Under counter dispensing systems are known in which hand cleaning fluids are dispensed from a soap spout above a countertop with the pumping mechanism to deliver the hand cleaning fluid to the soap spout from a removable and replaceable liquid containing bottle disposed under the countertop.

For example, U.S. Pat. No. 7,364,053 to Ophardt, issued Apr. 29, 2009, the disclosure of which is incorporated herein by reference, illustrates a soap dispenser for dispensing a foamed liquid soap out of a soap dispensing spout mounted adjacent a washroom sink with the liquid soap and air being delivered to the soap dispensing spout from a liquid pump and an air pump disposed below the counter. Various counter-mounted liquid dispensers and mounting systems for the same are known including, for example, systems taught by U.S. Patent Publication US 2009/0166381 to Phelps et al, issued Jul. 2, 2009 and U.S. Pat. No. 6,929,150 to Muderlak et al, issued Aug. 16, 2005, the disclosures of which are incorporated herein by reference.

Such known under counter dispensing systems suffer the disadvantage that replacement reservoirs need to be installed underneath the countertop for engagement with the dispensing system and that difficulties arise in respect of the coupling of the replacement reservoirs to the dispensing systems.

SUMMARY OF THE INVENTION

To at least partially overcome these and other disadvantages of previously known devices, the present invention provides a piston pump with a piston chamber-forming body and a piston-forming element relatively coaxially reciprocally movable to dispense liquid and air from a discharge outlet, which the discharge outlet is fixed relative to the piston chamber-forming body.

To overcome other disadvantages of previously known devices, the present invention provides a replaceable reservoir cartridge including a pump assembly and a delivery tube facilitating easy coupling of the cartridge to a housing arrangement disposed underneath a countertop.

As a 1$^{st}$ feature, the present invention provides a pump for simultaneously dispensing liquid and air comprising:

a piston chamber-forming body disposed about a central axis, a piston-forming element received in the piston chamber-forming body coaxially slidable inwardly and outwardly therein between an outward extended position and inward retracted position, the piston chamber-forming body having an inner tubular member extending axially between an axial inner end of the inner tubular member and an axially outer end of the inner tubular member, the inner tubular member having a circumferential side wall defining a central passage axially through the inner tubular member open both at the axial inner end of the inner tubular member and the axial outer end of the inner tubular member, the axially outer end of the inner tubular member open to a discharge outlet, the piston chamber-forming body having an outer tubular member extending axially between an axial inner end of the outer tubular member and an axially outer end of the outer tubular member, the outer tubular member disposed coaxially about the inner tubular member, the piston chamber-forming body having an annular flange fixedly connecting the outer tubular member to the inner tubular member, the annular flange extending radially inwardly from the outer tubular member to the inner tubular member closing the inner end of the outer tubular member, an annular air chamber defined annularly between the outer tubular member and the inner tubular member axially outwardly of the annular flange, the air chamber closed at an annular axially inner end of the air chamber by the annular flange and open axially outwardly through the axially outer end of the outer tubular member, at least one axially and circumferentially extending guide slot extending radially through the side wall of the inner tubular member between the air chamber and the central passage, the inner end of the inner tubular member in communication with liquid in a reservoir, a liquid chamber defined inside the inner tubular member axially inwardly of the guide slot, the piston-forming element having an axially extending tubular hollow inner stem extending between an axially inner stem inner end and an axially inner stem outer end, the inner stem having axially extending passageway therethrough closed at a passageway inner end and open at a passageway outer end through the inner stem outer end, the inner stem coaxially received within the inner tubular member for reciprocal coaxial sliding therein between the extended position and the retracted position with the inner stem inner end coaxially slidably received in the liquid chamber and the inner stem outer end coaxially slidably received in the inner tubular member axially outwardly of the guide slot, the piston-forming element having an annular sealing member coaxially slidably received in the air chamber spanning radially between the outer tubular member and the inner tubular member, the piston-forming element having at least one spoke member extending radially through the guide slot to fixedly couple the inner stem to the annular sealing member with the spoke member being axially slidable in the guide slot with coaxial sliding of the piston-forming element relative to the piston chamber-forming body between the extended position and the retracted position, the inner stem inner end carrying a fluid piston portion coaxially slidably received in the liquid chamber defining with the liquid chamber, a liquid pump which, with reciprocal coaxial sliding of the piston-forming element relative the piston chamber-forming body, draws the liquid from the reservoir and discharges the liquid into the passageway, axially outwardly through the passageway and out the passageway outer end into the central passage of the inner tubular member, the annular sealing member having a radially outer seal member engaging the outer tubular member to prevent fluid flow outwardly therebetween and a radially inner seal member engaging the inner tubular member axially outwardly of the guide slot to prevent fluid flow outwardly therebetween, the annular sealing member coaxially slidably received in the air chamber defining with the air chamber an air pump which, with reciprocal coaxial sliding of the piston-forming element relative the piston chamber-forming body, draws air from the atmosphere into the air chamber and discharges air from the air chamber radially inwardly through the guide slot to the central passage, wherein with reciprocal coaxial sliding of the piston-forming element relative the piston chamber-forming body, liquid discharged by the liquid pump and air discharged by the air pump are simultaneously passed through the central passage and out the discharge outlet.

As a $2^{nd}$ feature, the invention provides a pump as in the $1^{st}$ feature including a one-way air inlet valve to permit air from the atmosphere to be drawn into the air chamber by the air pump when the air pump creates across the one-way air inlet valve a sufficient vacuum below a pressure of the atmosphere air pressure.

As a $3^{rd}$ feature, the invention provides a pump as in the $2^{nd}$ feature wherein the one-way air inlet valve permits air from the atmosphere adjacent to the piston chamber-forming body to be drawn into the air chamber by the air pump when the air pump creates across the one-way air inlet valve a sufficient vacuum below a pressure of the atmosphere air pressure.

As a $4^{th}$ feature, the invention provides a pump as in any one of the $1^{st}$, $2^{nd}$ or $3^{rd}$ features a pump including a radial transfer port radially through the inner stem into the passageway axially outwardly of the liquid pump, wherein the air pump discharges air from the air chamber radially inwardly through the guide slot into the central passage about the inner stem open to the radial transfer port and hence through the radial transfer port into the passageway, then simultaneously with the fluid discharged by the liquid pump axially outwardly through the passageway and out the passageway outer end into the central passage of the inner tubular member axially outwardly of the inner stem outer end.

As a $5^{th}$ feature, the invention provides a pump as in any one of the $1^{st}$ to $3^{rd}$ features including:

an annular space extending axially within the central passage radially between the inner stem and the side wall of the inner tubular member open to the guide slot, the annular space axially outwardly of the liquid pump and closed at an axial inner end by the fluid pump, a transfer pathway providing communication from the annular space to outwardly of the inner stem outer end, wherein the air pump discharges air from the air chamber radially inwardly through the guide slot into the annular space and via the transfer pathway to outwardly of the inner stem outer end.

As a $6^{th}$ feature, the invention provides a pump as in the $5^{th}$ feature wherein:

the transfer pathway includes a first pathway provided by the annular space extending axially within the central passage radially between the inner stem and the side wall of the inner tubular member open to outwardly of the inner stem outer end of the inner stem, and the air pump discharges air from the air chamber radially inwardly through the guide slot into the annular space through the annular space to the central passage axially outwardly of the inner stem outer end, and then, simultaneously with the fluid discharged by the liquid pump from the passageway outer end, axially outwardly from the inner stem outer end through the central passage to the discharge outlet.

As a $7^{th}$ feature, the invention provides a pump as in the $5^{th}$ or $6^{th}$ feature wherein:

the transfer pathway includes a second pathway provided by a radial transfer port from the annular space radially through the inner stem into the passageway axially outwardly of the liquid pump, and the air pump discharges air from the air chamber radially inwardly through the guide slot into the annular space to the radial transfer port and hence through the radial transfer port into the passageway, and then simultaneously with the fluid discharged by the liquid pump axially outwardly through the passageway and out the passageway outer end to the central passage of the inner tubular member axially outwardly of the inner stem outer end.

As an $8^{th}$ feature, the invention provides a pump as in any one of the $1^{st}$ to $3^{rd}$ features including:

a transfer passage provided through the central passage axially outwardly of the liquid pump, the transfer passage providing communication from the guide slot to outwardly of the inner stem outer end, wherein the air pump discharges air from the air chamber radially inwardly through the guide slot and via the transfer passage to outwardly of the inner stem outer end.

As a $9^{th}$ feature, the invention provides a pump as in any one of the $1^{st}$ to $8^{th}$ features wherein the liquid chamber is defined inside the inner tubular member proximate the inner end of the inner tubular member.

As a $10^{th}$ feature, the invention provides a pump as in any one of the $1^{st}$ to $9^{th}$ features wherein:

the piston-forming element having an engagement member adapted for engagement by an actuator for axial movement of the piston-forming element relative to the piston chamber-forming body.

As an $11^{th}$ feature, the invention provides a pump as in the $10^{th}$ feature wherein the engagement member is carried on the annular sealing member.

As a $12^{th}$ feature, the invention provides a pump as in any one of the $10^{th}$ or $11^{th}$ features wherein:

the engagement member comprises an engagement flange extending radially outwardly from the inner stem axially outwardly of the outer tubular member.

As a $13^{th}$ feature, the invention provides a pump as in any one of the $1^{st}$ to $12^{th}$ features wherein:

the side wall of the inner tubular member having a radially inwardly directed inner surface and a radially outwardly directed outer surface, the outer tubular member having a circumferential side wall coaxially circumferentially there about with a radially inwardly directed inner surface, the radially outer seal member of the annular sealing member engaging the radially inwardly directed inner surface of the outer tubular member to prevent fluid flow inwardly and outwardly therebetween, and the radially inner seal member of the annular sealing member engaging radially outwardly directed outer surface of the inner tubular member axially outwardly of the guide slot to prevent fluid flow outwardly therebetween.

As a $14^{th}$ feature, the invention provides a pump as in any one of the $1^{st}$ to $13^{th}$ features wherein:

the radially inner seal member of the annular sealing member engaging the inner tubular member axially outwardly of the guide slot to prevent fluid flow both inwardly and outwardly therebetween.

As a $15^{th}$ feature, the invention provides a pump as in any one of the $1^{st}$ to $13^{th}$ features wherein:

the radially inner seal member of the annular sealing member engaging the inner tubular member axially outwardly of the guide slot to permit air from the atmosphere to flow inwardly therebetween into the air chamber when a sufficient pressure differential exists across the annular sealing member.

As a $16^{th}$ feature, the invention provides a pump as in any one of the $1^{st}$ to $15^{th}$ features wherein the radially inwardly directed inner surface of the outer tubular member having a diameter larger than a diameter of the radially outwardly directed outer surface of the inner tubular member.

As a $17^{th}$ feature, the invention provides a pump as in any one of the $1^{st}$ to $16^{th}$ features wherein the fluid piston portion including:

an inner disc on the inner stem extending radially outwardly from the inner stem engaging the radially inwardly directed side wall of the inner tubular member axially inwardly from the guide slot to prevent liquid flow axially outwardly between the inner disc and the inner tubular member but to permit fluid flow axially outwardly therebetween, an outer disc on the inner stem spaced axially outwardly from the inner disc and extending radially outwardly from the inner stem engaging the radially inwardly directed side wall of the inner tubular member to prevent liquid flow axially inwardly and outwardly therepast, a liquid port located on the inner stem between the inner disc and the outer disc providing communication through the inner stem into the passageway, and a one-way liquid inlet valve permitting liquid flow from the reservoir into the inner end of the inner tubular member and preventing flow from the inner end of the inner tubular member to the reservoir.

As an $18^{th}$ feature, the invention provides a pump as in any one of the $1^{st}$ to $17^{th}$ features wherein the piston-forming element moving downwardly to slide inwardly relative the piston chamber-forming body and the piston-forming element moving upwardly to slide outwardly relative the piston chamber-forming body.

As a $19^{th}$ feature, the invention provides a pump as in the $18^{th}$ feature wherein the central axis is vertical.

In another aspect, the present invention provides a piston pump having:

a piston chamber-forming body having an inner tubular member and an outer tubular member fixedly mounted coaxially about the inner tubular member;

axially extending guide slots through the inner tubular member;

a piston-forming element having an inner stem axially slidably received inside the inner tubular member forming axially inwardly of the guide slots, a liquid pump for discharging fluid from an axially inner end of the inner stem through the stem to exit the stem into the inner tubular member axially outwardly of the guide slots;

the piston-forming element having an annular sealing member coaxially slidably received annularly between the inner tubular member and the outer tubular member forming axially outwardly of the guide slots, an air pump to discharge air through the guide slots into the inner tubular member, and the inner stem coupled to the annular sealing member via at least one spoke member extending radially through the guide slot.

In another aspect, the present invention provides a pump for simultaneously dispensing liquid and air comprising:

a piston chamber-forming body disposed about a central axis, a piston-forming element received in the piston chamber-forming body coaxially slidable inwardly and outwardly therein between an outward extended position and an inward retracted position;

the piston chamber-forming body having an inner tubular member extending axially between an axial inner end of the inner tubular member and an axially outer end of the inner tubular member;

the inner tubular member having a circumferential side wall defining a central passage axially through the inner tubular member open both at the axial inner end of the inner tubular member and the axial outer end of the inner tubular member, the axially outer end of the inner tubular member open to a discharge outlet, the piston chamber-forming body having an outer tubular member extending axially between an axial inner end of the outer tubular member and an axially outer end of the outer tubular member, the outer tubular member disposed coaxially about the inner tubular member, the piston chamber-forming body having an annular flange fixedly connecting the outer tubular member to the inner tubular member, the annular flange extending radially inwardly from the outer tubular member to the inner tubular member closing the inner end of the outer tubular member, an annular air chamber defined annularly between the outer tubular member and the inner tubular member axially outwardly of the annular flange, the air chamber closed at an annular axially inner end of the air chamber by the annular flange and open axially outwardly through the axially outer end of the outer tubular member, at least one axially and circumferentially extending guide slot extending radially through the side wall of the inner tubular member between the air chamber and the central passage, the inner end of the inner tubular member in communication with liquid in a reservoir, a liquid chamber defined inside the inner tubular member axially inwardly of the guide slot, the piston-forming element having an axially extending tubular hollow inner stem extending between an axially inner stem inner end and an axially inner stem outer end, the inner stem having axially extending passageway therethrough closed at a passageway inner end and open at a passageway outer end through the inner stem outer end, the inner stem coaxially received within the inner tubular member for reciprocal coaxial sliding therein between the extended position and the retracted position with the inner stem inner end coaxially slidably received in the liquid chamber and the inner stem outer end coaxially slidably received in the inner tubular member axially outwardly of the guide slot, the piston-forming element having an annular sealing member coaxially slidably received in the air chamber spanning radially between the outer tubular member and the inner tubular member, the piston-forming element having at least one spoke member extending radially through the guide slot to fixedly couple the inner stem to the annular sealing member with the spoke member being axially slidable in the guide slot with coaxial sliding of the piston-forming element relative to the piston chamber-forming body between the extended position and the retracted position, the piston-forming element having an engagement member carried on the annular sealing member axially outwardly of the outer tubular member, the engagement member adapted for engagement by an actuator for axial movement of the piston-forming element relative to the piston chamber-forming body, the inner stem inner end carrying a fluid piston portion coaxially slidably received in the liquid chamber defining with the liquid chamber, a liquid pump which, with reciprocal coaxial sliding of the piston-forming element relative the piston chamber-forming body, draws the liquid from the reservoir and discharges the liquid into the passageway, axially outwardly through the passageway and out the passageway outer end into the central passage of the inner tubular member, the annular sealing member having a radially outer edge seal member engaging the outer tubular member to prevent fluid flow inwardly and outwardly therebetween and a radially inner edge seal member engaging the inner tubular member axially outwardly of the guide slot to prevent fluid flow inwardly and outwardly therebetween, the annular sealing member coaxially slidably received in the annular air chamber defining with the annular air chamber an air pump which, with reciprocal coaxial sliding of the piston-forming element relative the piston chamber-forming body, draws air from the atmosphere into the air chamber and discharges air from the annular air chamber radially inwardly through the guide slot to the central passage, wherein with reciprocal coaxial sliding of the piston-forming element relative the piston chamber-forming body, liquid discharged by the liquid pump is simultaneously discharged with air discharged by the air pump through the central passage and out the discharge outlet.

BRIEF DESCRIPTION OF THE DRAWING

Further aspects and advantages of the present invention will become apparent from the following description taken together with the accompany drawings in which.

DETAILED DESCRIPTION OF THE DRAWINGS

Figure 1:
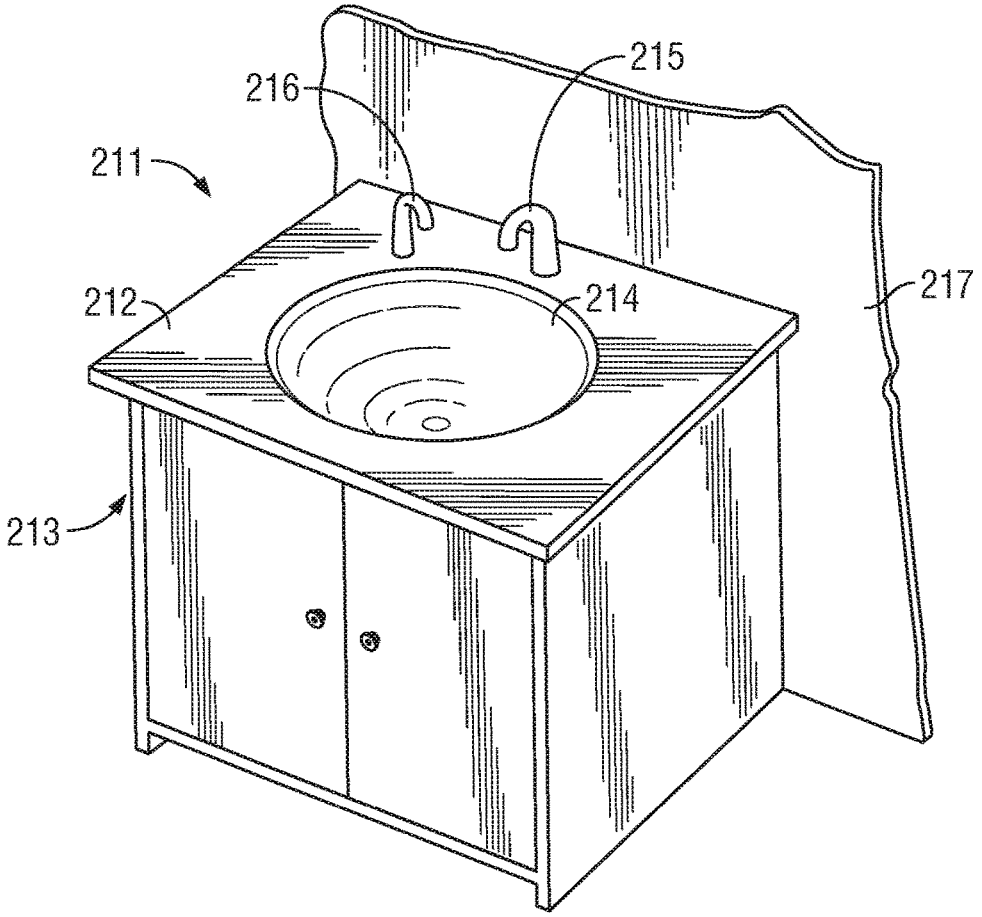
FIG. 1 is a pictorial view of a washroom counter-mounted sink with a single soap dispenser in accordance with the first embodiment of the present invention.

FIG. 1 illustrates a touchless hand washing station 211 as in a washroom comprising a countertop 212 supported on a cabinet base 213 adjacent a room wall 217. A sink 214 is mounted in the countertop 212 with a water dispensing faucet 215 mounted to extend upwardly from the countertop at the rear of the sink and a soap dispensing spout 216 mounted to extend upwardly from the countertop 212 adjacent one side of the sink 214.

Figure 2:
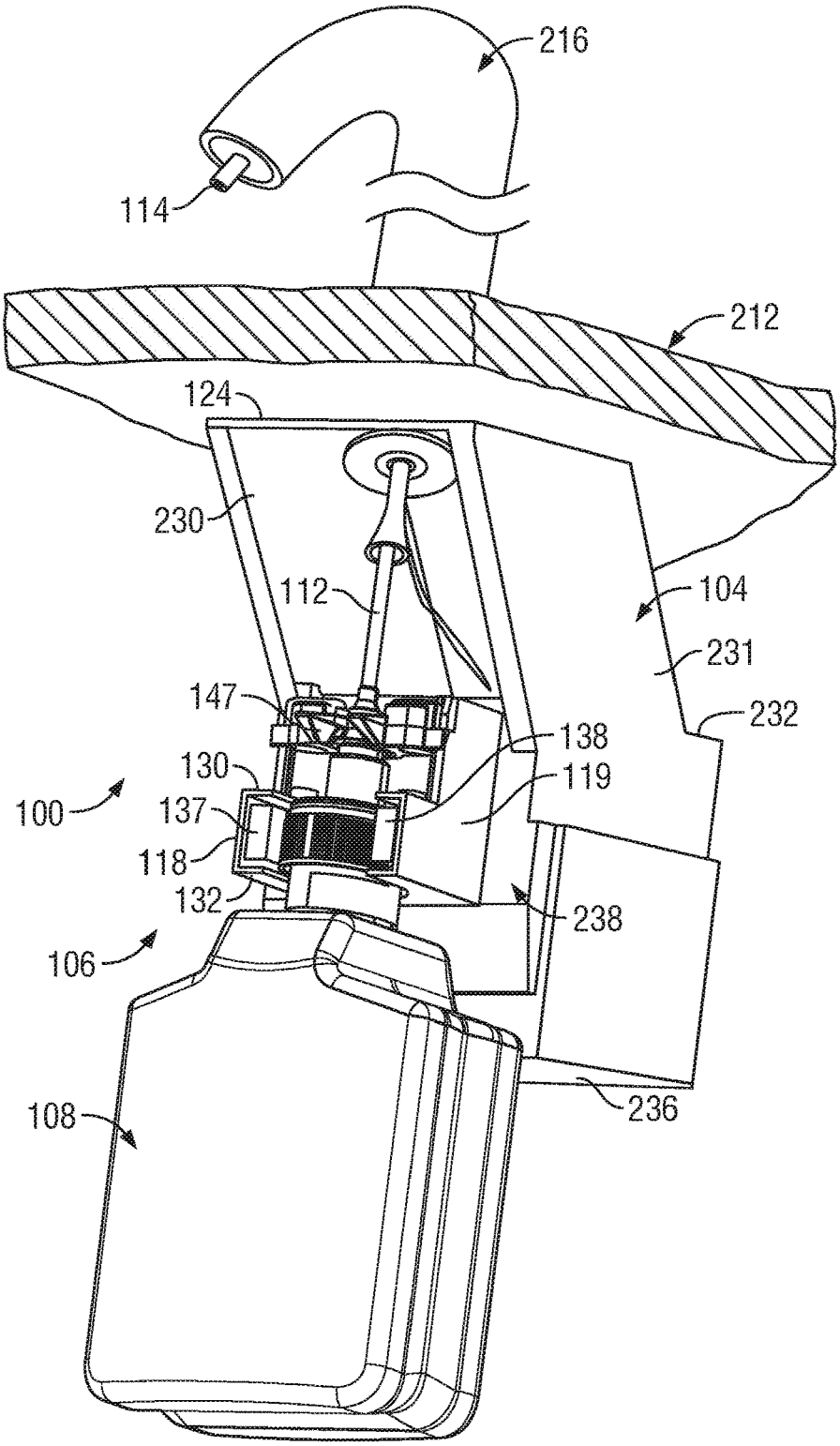
FIG. 2 is a schematic pictorial view of the underside of the countertop shown in FIG. 1 illustrating a dispensing mechanism coupled to the soap dispensing spout in an assembled operative condition.

Reference is made to FIG. 2 which illustrates a dispensing apparatus 100 mounted to the countertop 212. The dispensing assembly 100 includes a dispenser housing 104 and a removable and replaceable cartridge 106.

Figure 6:
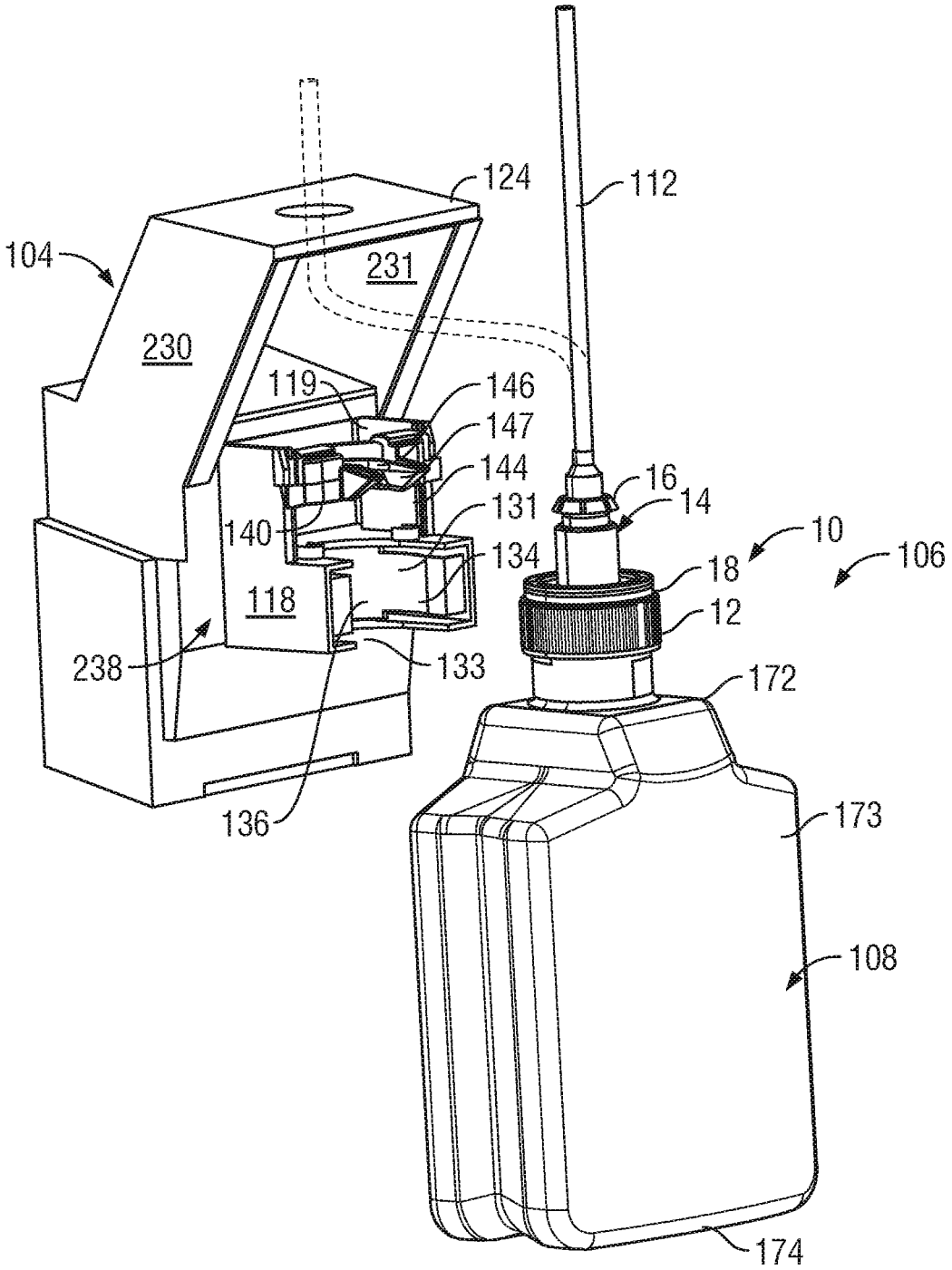
FIG. 6 is a pictorial exploded view showing the dispenser housing and the replaceable cartridge of FIG. 2 uncoupled.
Figure 7:
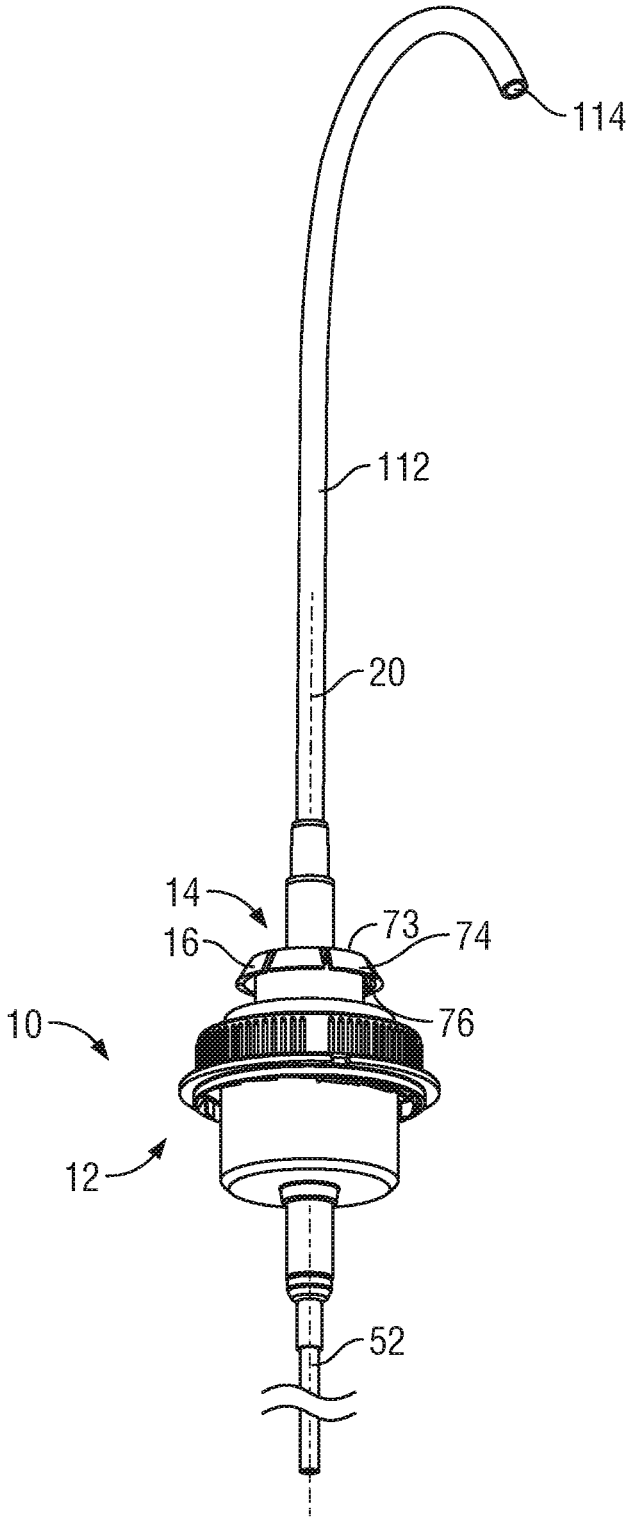
FIG. 7 is a pictorial view of a first embodiment of a pump assembly of the removable cartridge of FIG. 6 with a piston-forming element in a retracted position relative to a piston chamber-forming body.

As seen on FIGS. 2 and 6, the cartridge 106 comprises a reservoir bottle 108, a pump assembly 10 secured to the bottle 108 and a delivery tube 112 extending from the pump assembly 10 to a discharge outlet 114.

Figure 3:
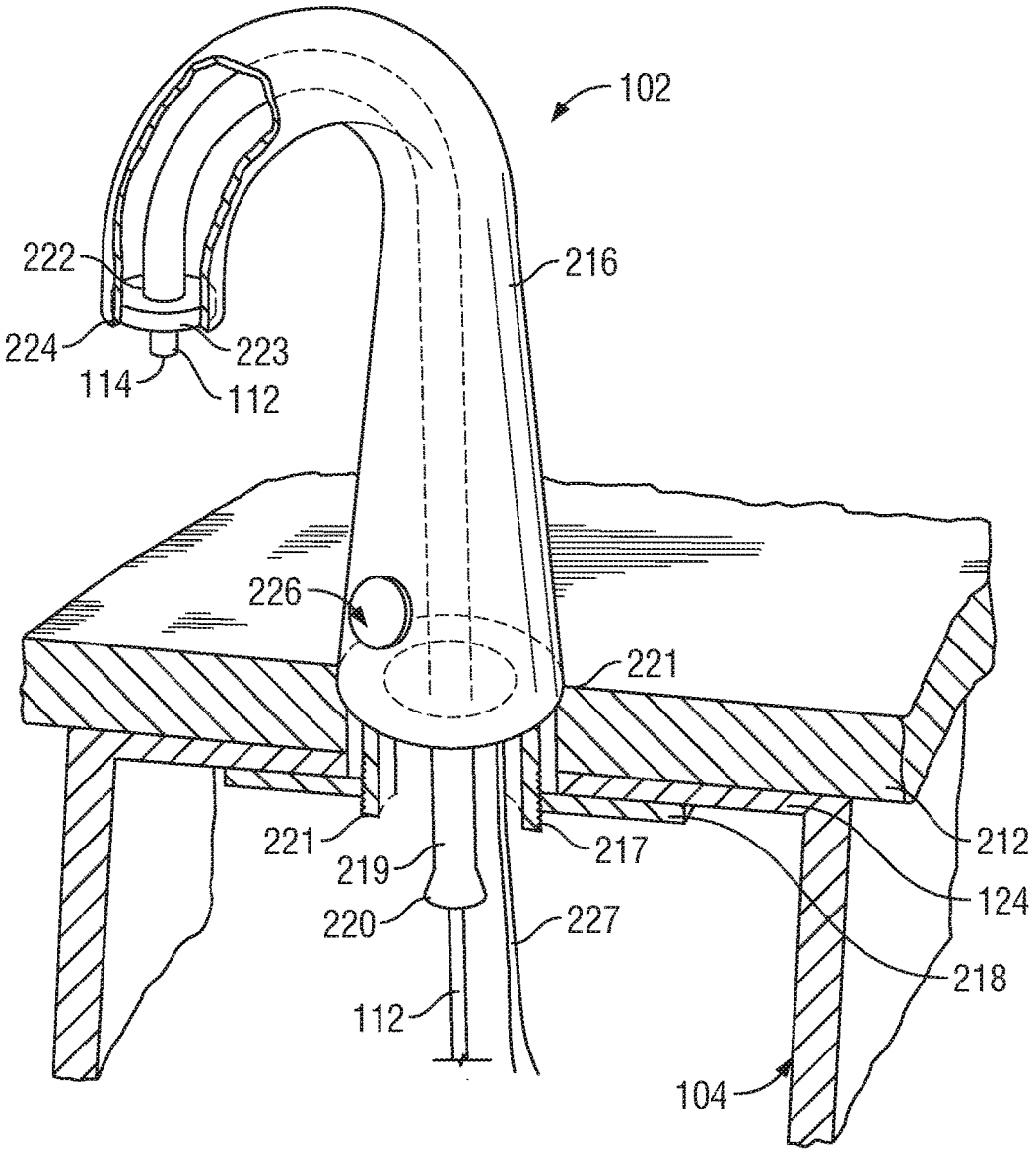
FIG. 3 is a schematic pictorial view of the soap dispenser spout of FIG. 1.
Figure 4:
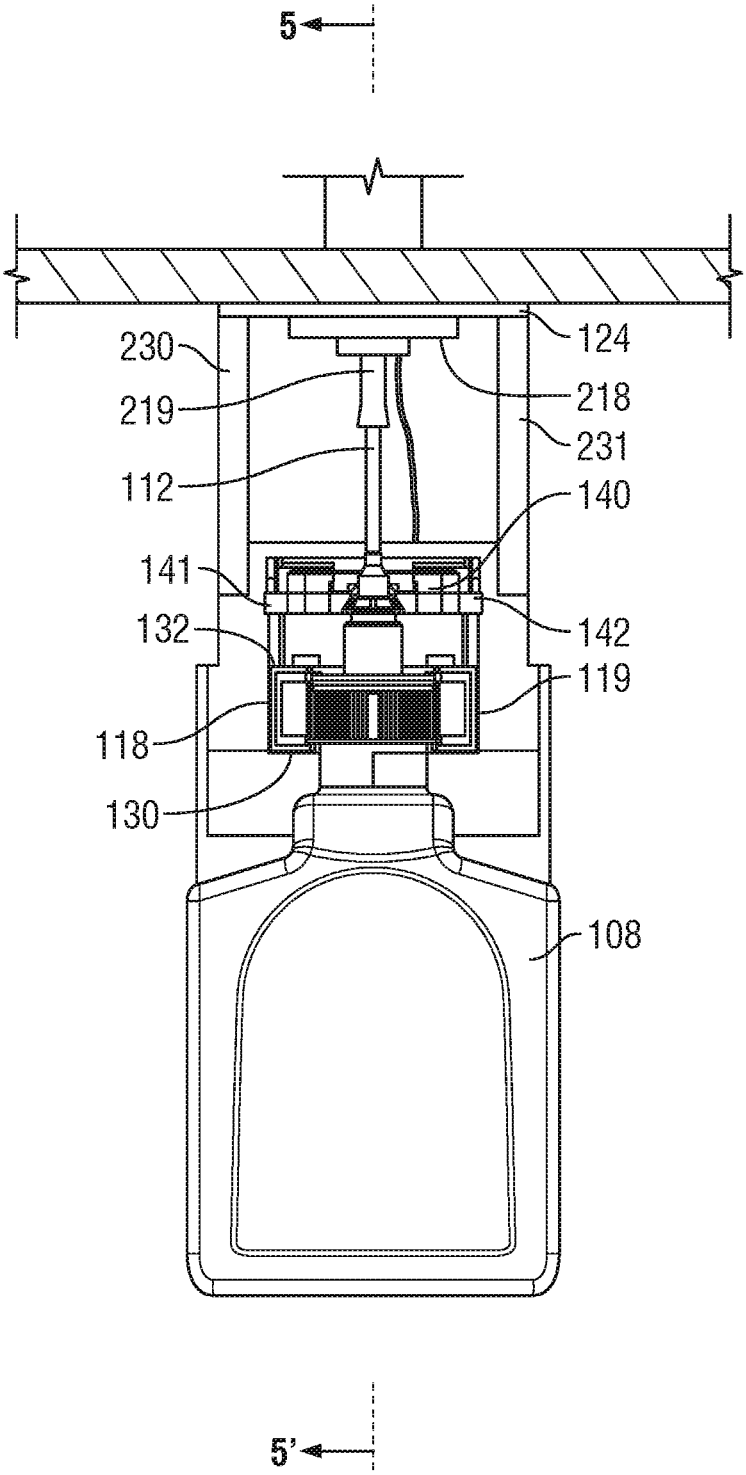
FIG. 4 is a front view of FIG. 2.

As seen in FIG. 3, a soap dispensing spout assembly 102 comprises the hollow tubular spout 216 from which at a lower end 221, an inlet tube 217 extends downwardly. The inlet tube 217 carries external threads. The inlet tube 217 extends downwardly through the countertop 212. A lock nut 218 is threaded onto the inlet tube 217 securing to the countertop 212, both the spout assembly 102 and a mount plate 124 for the dispenser housing 104 thereby securely mount the spout assembly 102 and the dispenser housing 104 to the countertop 212.

A guide tube 219 is secured within the spout 216 extending internally within the spout 216 from an enlarged funnel-like open insert end 220 of the guide tube 219 that extends downwardly as through the open lower end 221 of the inlet tube 217. The guide tube 219 extends from its insert end 220 through the spout 216 to an outlet end 222 of the guide tube 219 secured in an outlet plate 223 fixed in a spout opening 224 of the spout 216. As only schematically shown in FIG. 3, the flexible delivery tube 112 of the removable cartridge 106 extends coaxially within the guide tube 219 and presents the open discharge outlet 114 extending marginally out of the outlet end 222 of the guide tube 219 and through the outlet plate 223.

The spout 216 carries a sensor mechanism 226 which senses the presence of a user's hand proximate the spout 216 and suitably activates the dispensing apparatus 100 to discharge soap, liquid and air out the discharge outlet 114 of the delivery tube 112. A sensor communication wire 227 extends from the sensor mechanism 226 internally through the spout 216 and out the inlet tube 217 into the dispenser housing 104. The sensor mechanism 226 may preferably comprise an emitter to emit radiation, preferably infrared light, and a sensor to sense light reflected from a user's hands. Many touchless activation mechanisms are known and many suitably preferred mechanisms utilize infrared light or the specific nature of the sensor is not limited.

The preferred embodiment illustrated in FIGS. 1 to 6 shows an arrangement to touchlessly and automatically dispense fluid with a pump mechanism. However, the present invention is also applicable to arrangements in which the pump mechanism is manually operated such as, for example, with a modified spout assembly in which the spout 216 provides a manually operated actuator above the countertop 212 which transfers manual forces downwardly to reciprocally moving elements of a piston pump to dispense fluid as against the bias of a return spring mechanism. Such a manually operated arrangement is illustrated, for example, in U.S. Pat. No. 6,142,342 to Lewis, issued Nov. 7, 2000, the disclosure of which is incorporated herein by reference.

The guide tube 219 preferably has at its lower insert end 220 a funnel portion presenting an enlarged outer opening which facilitates the insertion of the delivery tube 112 into the guide tube 219.

As seen in FIG. 6, the pump assembly 10 includes a piston chamber-forming body 12 secured to the bottle 108 and a piston-forming element 14 coaxially slidable relative to the piston chamber-forming body 12 to dispense liquid from within the bottle 108 together with atmospheric air through the delivery tube 112. The piston-forming element 14 carries an engagement flange 16. The piston chamber-forming body 12 carries a collar 18.

Figure 5:
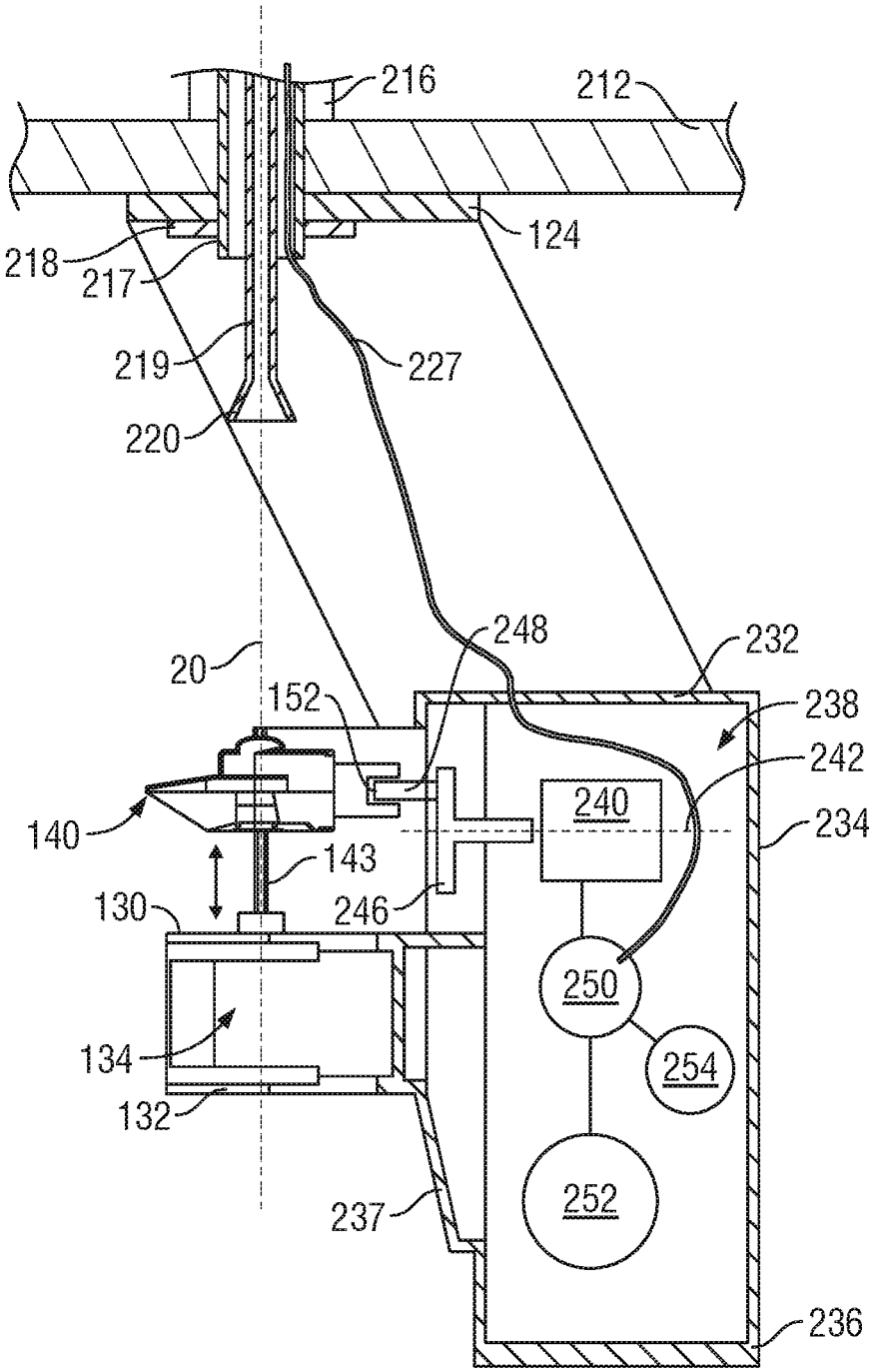
FIG. 5 is a cross-sectional side view along centre section line 5-5' in FIG. 4 but with the cartridge removed.

Reference is made to FIGS. 2 to 6 showing the dispenser housing 104. The dispenser housing 104 includes the mounting plate 124 from which two spaced side wall members 230,231 extend downwardly. As seen in FIG. 5, a top wall member 232, a rear wall member 234, a bottom wall member 236 and a front wall member 237 each bridge between the slide wall members 230 and 231 and define therebetween an enclosed compartment 238. The top wall member 232 is vertically spaced from the mounting plate 124 with the mounting plate 124 and the side wall members 230 and 231 above the top wall member effectively forming a mounting yoke. Two side plates 118 and 119 extend forwardly from the front wall member 238. A top support flange 130 and a bottom support flange 132 extend between the side plates 118 and 119. Each of the top support flange 130 and the bottom support flange 132 has a respective slotway 131 and 133 extending thereinto from a semicircular rear blind end to a forwardly directed opening. A forwardly directed collar receiving slotway 134 is defined vertically between the top support flange 130 and the bottom support flange 132 and horizontally between the side plates 118 and 119 adapted to securely receive therein the collar 18 on the piston chamber-forming body 12 so as to fixedly secure the piston chamber-forming body 12 and the bottle 108 to the dispenser housing 104 for removable coupling and uncoupling by horizontal sliding rearwardly or forwardly, respectively.

Within the collar receiving slotway 134, there is provided a resilient yoke member 136 secured at its rear to the rear plate 116 and having two resilient arms 137 and 138 which extend forwardly, one adjacent each of the side plates 118 and 119 to engage the collar 18 in a snap-fit relation requiring a threshold force to be applied to move the collar 18 either into or out of the collar receiving slotway 134.

Above the top support flange 130, a horizontally extending actuator plate 140 is provided coupled at its opposite sides 141 and 142 to the side plates 118 and 119 for relative vertically sliding. In this regard, the side plates 118 and 119 preferably carry vertically extending channel members 143 and 144 to be engaged by slide members on the sides of the actuator plate 140 towards guiding the actuator plate 140 in sliding vertically relative to the dispenser housing 104. The actuator plate 140 carries a catch member 147 that defines a central cavity 146 adapted to receive the engagement flange 16 of the piston-forming element 14.

FIG. 6 illustrates an exploded condition in which the cartridge 106 is in an uncoupled orientation forward of the dispenser housing 104 and from which uncoupled orientation by mere horizontal rearward movement of the cartridge 106, the collar 18 becomes coaxially received within the collar receiving slotway 134 and the engagement flange 16 becomes coaxially received within the central cavity 146 engaged by the catch member 147 to be vertically movable with the actuator plate 140. In the preferred embodiments, the configuration of the actuator plate 140 and its cavity 146 and the configuration of the engagement flange 16 is preferably substantially identical to that disclosed in U.S. Pat. No. 8,113,388 to Ophardt et al, issued Feb. 14, 2012, the disclosure of which is incorporated herein by reference. As a simple summary, by mere rearward and forward sliding of cartridge 106, possibly with an initial vertical cycling of the actuator plate 140, the cartridge 106 is coupled to the dispenser housing 104 such that movement of the actuator member 140 moves the piston-forming element 14 relative the piston chamber-forming body 12 to dispense materials from the discharge outlet 114.

Reference is made to FIG. 5 which schematically illustrates within the compartment 238 a motor 240 schematically shown for rotation about an axis 242 of an output shaft 244 carrying a rotating wheel 246 coaxially with the shaft 244. A crank pin 248 is mounted at one circumferential location on the wheel 246. The crank pin 248 is received within a rearwardly opening horizontally extending slot 152 in the actuator plate 140. With rotation of the shaft 244 and the wheel 246, engagement between the crank pin 248 and the actuator plate 140 causes the actuator plate 140 to slide vertically upwardly and downwardly in a reciprocal manner relative to the dispenser housing 104.

Schematically shown within the compartment 238 is a control mechanism 250 and a power source 252. The sensor communication wire 227 is shown as being connected to the control mechanism 250. The control mechanism 250 controls the manner of distribution of power to the motor 240 and to the sensor mechanism 226. The control mechanism 250 may have communication capabilities as via a communication module 254 for communicating with remote devices.

Such an automated mechanism for controlling the movement of the actuator plate 140 may be of the type disclosed in U.S. Pat. No. 8,201,707 to Ophardt, issued Jun. 19, 2012 and U.S. Pat. No. 8,245,877 to Ophardt, issued Aug. 21, 2012, the disclosures of which are incorporated herein by reference.

The delivery tube 112 is of a length that with the cartridge 106 engaged on the dispenser housing 104, the discharge outlet 114 of the delivery tube 112 is suitably positioned preferably extending marginally outwardly from the outlet plate 223 of the spout 216.

For coupling of the cartridge 106 to the dispenser apparatus 100, preferably, prior to the cartridge 106 being coupled to the dispenser housing 104, the flexible delivery tube 112 is manually bent and fed into and through the guide tube 219 as may be understood from broken lines on FIG. 6. Subsequently, with horizontal rearward movement of the cartridge 106, the delivery tube 112 is fed further upwardly through the guide tube 219. Having regard to the extent to which the delivery tube 112 is flexible and the spacing between the insert end 220 of the guide tube 219 and the pump assembly 10 when engaged on the dispenser housing 104, the pump assembly 10 may first be engaged with the dispenser housing 104 and, after such engagement, the delivery tube 112 then deflected and passed upwardly through the guide tube 219.

In accordance with the first embodiment, compared to an axis passing through the actuator member 140, coupling of the cartridge 106 is accomplished by merely radial movement of the pump assembly 10. Coupling of the cartridge 106 to the dispenser housing 104 with suitable engagement of the delivery tube 112 inside the guide tube 219 is preferably accomplished in accordance with the preferred embodiment by mere forward and rearward horizontal sliding of the cartridge 106 other than suitable flexing and manipulation of the delivery tube 112. However, various other arrangements may be provided in accordance with the present invention for coupling of the cartridge 106 to the dispenser housing 104 as may involve vertical, relative movement of the cartridge 106 relative to the dispenser housing 104, alone or in combination with relative radial movement. For example, coupling may be accomplished merely by axial movement or by a combination of axial and radial movement with or without tilting of the pump assembly.

The preferred actuator member 140 is shown as being merely axially slidable relative to the dispenser housing 104. However, the actuator member 140 may be mounted for other simple relative movement of the actuator member 140 such as on a lever pivotably mounted to the dispenser housing 104. Relative movement can be as disclosed in U.S. Pat. No. 8,071,933 to Ophardt, issued Sep. 6, 2011 and U.S. Pat. No. 5,431,309 to Ophardt, issued Jul. 11, 1995, the disclosures of which are incorporated herein by reference.

Figure 8:
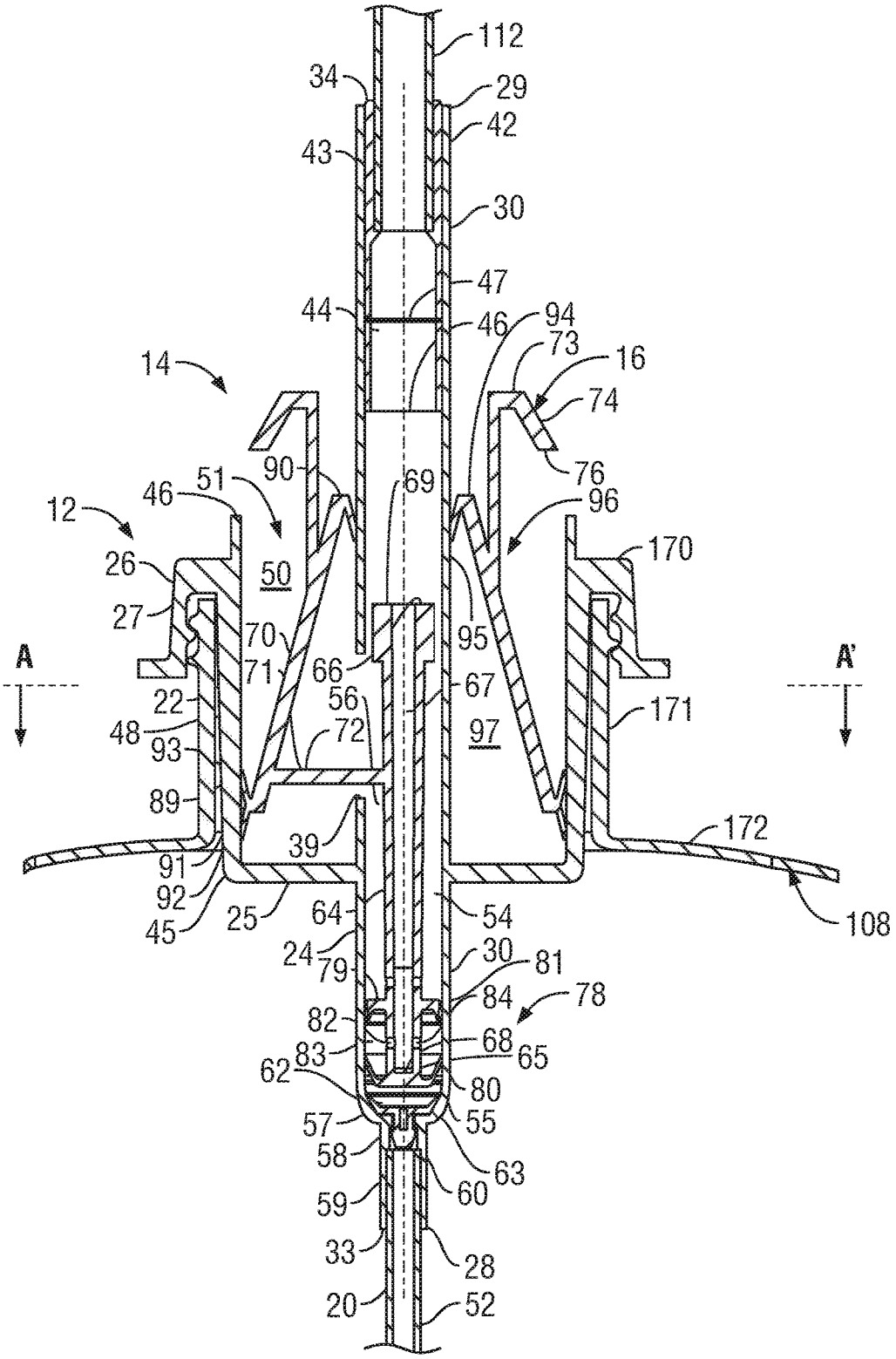
FIG. 8 is a vertical cross-sectional view of the pump assembly of FIG. 7 including the central axis and additionally showing an upper portion of a bottle of the replaceable cartridge.

Reference is made to FIGS. 6 and 8 showing the bottle 108. The bottle 108 is enclosed but for an opening 170 provided at an axially outer end of a threaded neck 171 of the bottle 108 which is coupled to a top wall 172 of the bottle 108. The top wall 172 merges into a side wall 173 and, hence, into a bottom wall 174. A liquid is contained within the bottle 108 and the pump assembly 10 is adapted to discharge the liquid from bottle 108.

Reference is made to FIGS. 7 to 10 showing a first embodiment of the pump assembly 10 of FIG. 6.

As seen in the cross-section of FIG. 8, the pump assembly 10 has a piston chamber-forming body 12 and a piston-forming element 14. Each of the piston chamber-forming body 12 and the piston-forming element 14 are substantially disposed coaxially about a central axis 20. Coaxial reciprocal movement of the piston-forming element 14 relative the piston chamber-forming body 12 about the axis 20 between an axially retracted position as shown in FIG. 8 and an axially extended position shown in FIG. 9, dispenses the liquid from the bottle 108 mixed with air from the atmosphere as a foam through the delivery tube 112.

The piston chamber-forming body 12 has a radially outer tubular member 22 and a radially inner tubular member 24 joined by an annular flange 25.

The outer tubular member 22 carries an outer collar tube 26 having a threaded radially inwardly directed surface 27 carrying threads for engagement with complementary threads on the threaded neck 171 of the bottle 108.

The inner tubular member 24 extends axially between an axial inner end 28 of the inner tubular member 24 and an axially outer end 29 of the inner tubular member 22. The inner tubular member 24 has a circumferential side wall 30 which is circular in cross-section, substantially cylindrical and has a diameter. The inner tubular member 24 defines within the circumferential side wall 30 a central passage 32 axially through the inner tubular member 24 open both at the axial inner end 33 of the inner tubular member and the axial outer end 34 of the inner tubular member 24. Three axially and circumferentially extending guide slots 36 extend radially through the side wall 30 of the inner tubular member 24 into the central passage 32. Each guide slot 36 is circumferentially spaced from its adjacent guide slots 36. Each guide slot 36 is defined between opposed axially extending side walls 37 and 38 best seen on FIG. 10, an inner end wall 39 and an outer end wall 40 opposed to the an inner end wall 39 as best seen on FIG. 8.

The axially outer end 34 of the inner tubular member 24 at the axially outer end of the piston chamber-forming body 12 is open to the discharge outlet 114 via the discharge tube 112. At the axially outer end 34 of the inner tubular member 24, an annular socket 41 is provided open axially outwardly and adapted to receive in a snap-fit relation an inlet coupling 42 fixedly secured to an inlet end 43 of the delivery tube 112.

Axially inwardly from the socket 42, the inner tubular member 24 carries a foam generator 44. The foam generator 44 comprises a tubular spacer 45 and a pair of axially spaced screens 46 and 47. The particular nature of the foam generator 44 is not limited. The purpose of the foam generator 44 is to generate a mixture of a foamed air and liquid product on simultaneous passing of the air and liquid through the foam generator 44.

The outer tubular member 22 extends axially between an axial inner end 45 of the outer tubular member 22 and an axially outer end 46 of the outer tubular member 22. The outer tubular member 22 is disposed coaxially about the inner tubular member 24. The annular flange 25 fixedly connects the outer tubular member 22 and the inner tubular member 24. The annular flange 25 extends radially inwardly from the outer tubular member 22 to the inner tubular member 24 and closes the inner end 45 of the outer tubular member 22. The outer tubular member 22 has a wall 48 which is circular in cross-section, substantially cylindrical and has a diameter larger than the diameter of the side wall 30 of the inner tubular member 24.

An annular air chamber 50 is defined annularly between the outer tubular member 22 and the inner tubular member 24 axially outwardly of the annular flange 25. The air chamber 50 is closed at an annular axially inner end of the air chamber 50 by the annular flange 25. The air chamber 50 is open axially outwardly at an axial outer end 51 of the annular air chamber 50 opening axially outwardly through the axially outer end 46 of the outer tubular member 22.

The inner end 33 of the inner tubular member 24 is in communication with liquid in the bottle reservoir 108 via a dip tube 52.

A liquid chamber 54 is defined inside the inner tubular member 24 axially inwardly of the guide slots 36. The liquid chamber 54 is approximate the inner end 28 of the inner tubular member 24.

The liquid chamber 54 is defined within the inner tubular member 24 radially inwardly of the side wall 30 of the inner tubular member 24 between an axially inner end 55 and an axially outer end 56. The fluid chamber 54 is circular in cross-section, substantially cylindrical and has a diameter. The axially inner end 55 of the fluid chamber 54 is defined by a radially inwardly extending shoulder 57 with an inlet opening 58 coaxially therethrough opening axially inwardly into a socket 59 open axially inwardly. The socket 59 is adapted to frictionally receive an inner end 60 of the hollow tubular dip tube 52. The dip tube 52 extends downwardly to a lower end 61 disposed approximate the bottom wall 174 of the bottle 108. A one-way inlet valve 62 is secured in the inlet opening 58 in a snap-fit and includes a resilient disc 63 that engages the radially inwardly directed inner surface of the side wall 30 to permit fluid flow axially outwardly therepast yet to prevent fluid flow axially inwardly therepast as in a manner, for example, described in a similar one-way inlet valve in U.S. Pat. No. 5,676,277 to Ophardt issued Oct. 14, 1997, the disclosure of which is incorporated herein by reference.

The fluid chamber 54 is open at its axially outer end 56 via the guide slots 36 into the air chamber 50.

The piston-forming element 14 is generally coaxially about the axis 20.

The piston-forming element 14 has an axially extending tubular hollow inner stem 64 extending between an axially inner stem inner end 65 and an axially inner stem outer end 66. The inner stem 64 has an axially extending passageway 67 therethrough closed at a passageway inner end 68 proximate the inner stem inner end 65 and open at a passageway outer end 69 through the inner stem outer end 66.

The inner stem 64 is coaxially received within the inner tubular member 24 for reciprocal coaxial sliding therein between the extended position and the retracted position with the inner stem inner end 65 coaxially slidably received in the liquid chamber 54 and the inner stem outer end 66 coaxially slidably received in the inner tubular member 24 axially outwardly of the guide slots 36.

The piston-forming element 14 has an annular sealing member 70 coaxially slidably received in the air chamber 50 spanning radially between the outer tubular member 22 and the inner tubular member 24.

The piston-forming element 14 has a bridging member 71 with three spoke members 72, each extending radially through a respective one of the three guide slots 36 to fixedly couple the inner stem 64 to the annular sealing member 70 with each spoke member 72 being axially slidable in a respective guide slot 36 with coaxial sliding of the piston-forming element 14 relative to the piston chamber-forming body 12 between the extended position and the retracted position.

The piston-forming element 14 has an engagement flange 16 carried on the annular sealing member 70 axially outwardly of the outer tubular member 22. The engagement flange 16 is adapted for engagement by an actuator, namely, the actuator plate 140 for axial movement of the piston-forming element 14 relative to the piston chamber—forming body 12. The engagement flange 16 is to be coupled and uncoupled with the actuator plate 140 on the dispenser housing 104 and is provided at an axial location on the piston chamber-forming body 12 axially outwardly of the piston chamber-forming body 12, such that the engagement member 16 can be engaged with and disengaged from the actuator plate 140 by relative radial movement. To accommodate such engagement, the engagement flange 16 extends radially outwardly in the form of a circular disc 73 carrying a plurality of circumferentially spaced resilient finger members 74, each connected to the disc 73 at a first end 75 and extending radially outwardly and axially inwardly to a distal end 76. Adjacent finger members 74 are circumferentially spaced by radially and axially extending slots through the disc 73.

The inner stem inner end 65 is coaxially slidably received in the liquid chamber 54 defining with the liquid chamber 54 the liquid pump 78 which, with reciprocal coaxial sliding of the piston-forming element 14 relative the piston chamber-forming body 12, draws the liquid from the reservoir bottle 108 and discharges the liquid into the passageway 67 and axially outwardly through the passageway 67 out the passageway outer end 69 into the central passage 32 of the inner tubular member 24.

The inner stem 64 carries an axially innermost fluid piston portion 79 coaxially received within the fluid chamber 54 to form the liquid pump 78. The fluid piston portion 79 includes a resilient inner disc 80 that engages the side wall 30 of the inner tubular member 24 in the fluid chamber 54 to permit fluid flow axially outwardly therepast but to prevent fluid flow axially inwardly therepast. The fluid piston portion 79 includes an outer disc 81 that engages the side wall 30 of the inner tubular member 24 in the fluid chamber 54 to prevent fluid flow axially therepast. Liquid ports 82 located on the inner stem 64 between the outer disc 81 and the inner disc 80 extend coaxially through the inner stem 64 into the passageway 67. With reciprocal coaxial movement of the fluid piston portion 79 relative to the fluid chamber 54, fluid is drawn upwardly from the bottle 108 though the dip tube 52 past the one-way inlet valve 62 into the fluid chamber 54 in a retraction stroke and, in an opposite extension stroke, the fluid is discharged axially outwardly past the inner disc 80 into an annular space 83 radially outward of the inner stem 64 and radially inward of the side wall 30 and between the inner disc 80 and the outer disc 81 and hence via the liquid ports 82 radially through the inner stem 64 into the passageway 67 leading to the axially outer end 69. The operation of the liquid pump 78 is substantially the same as described in U.S. Pat. No. 5,676,277 to Ophardt referenced above. However, many other configurations of a piston pump may be adopted for the liquid pump 78 without departing from the present invention.

Axially outwardly on the inner stem 64 from the fluid piston portion 79, notably axially outward of the outer disc 81 of the fluid piston portion 79, transfer ports 84 are provided radially through the inner stem 64 into the passageway 67.

Figure 9:
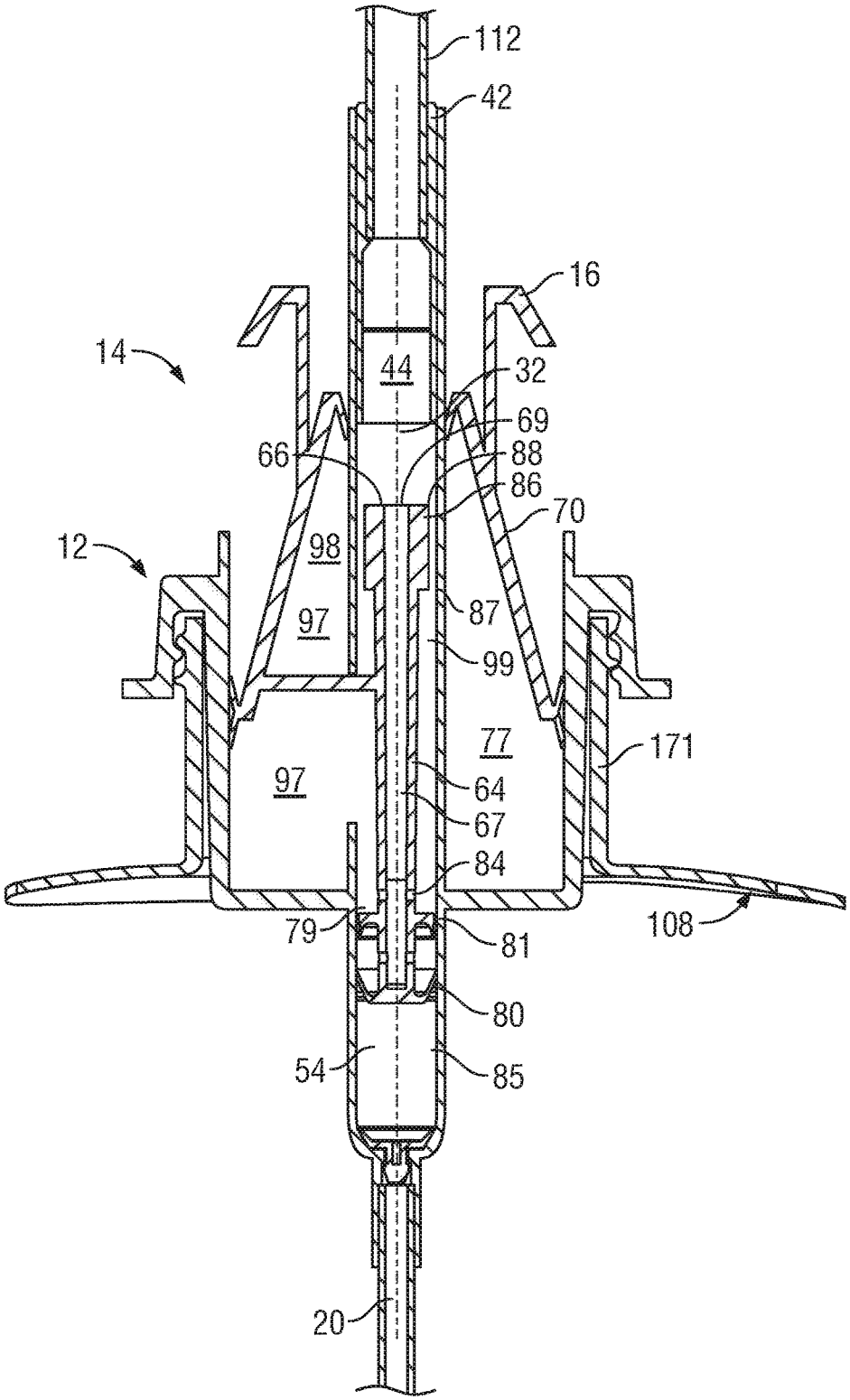
FIG. 9 is a vertical cross-sectional side view the same as FIG. 8, however, with the piston-forming element in an extended position relative to the piston chamber-forming body.
Figure 10:
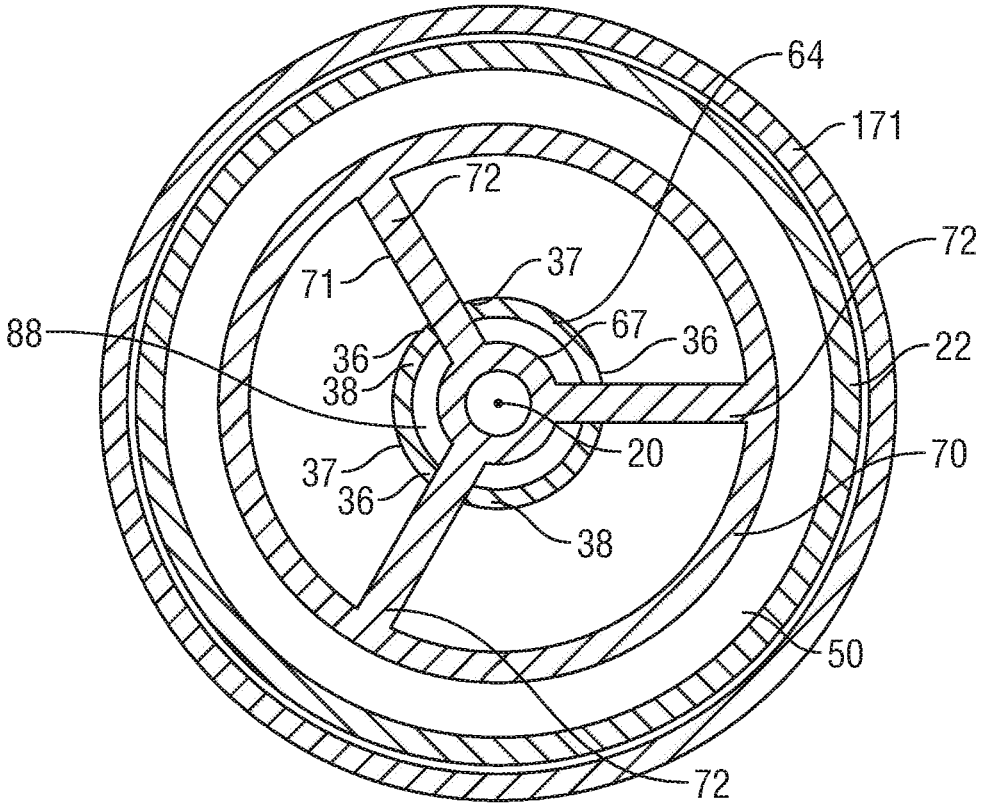
FIG. 10 is a radial cross-sectional side view along section line A-A' in FIG. 8.
Figure 11:
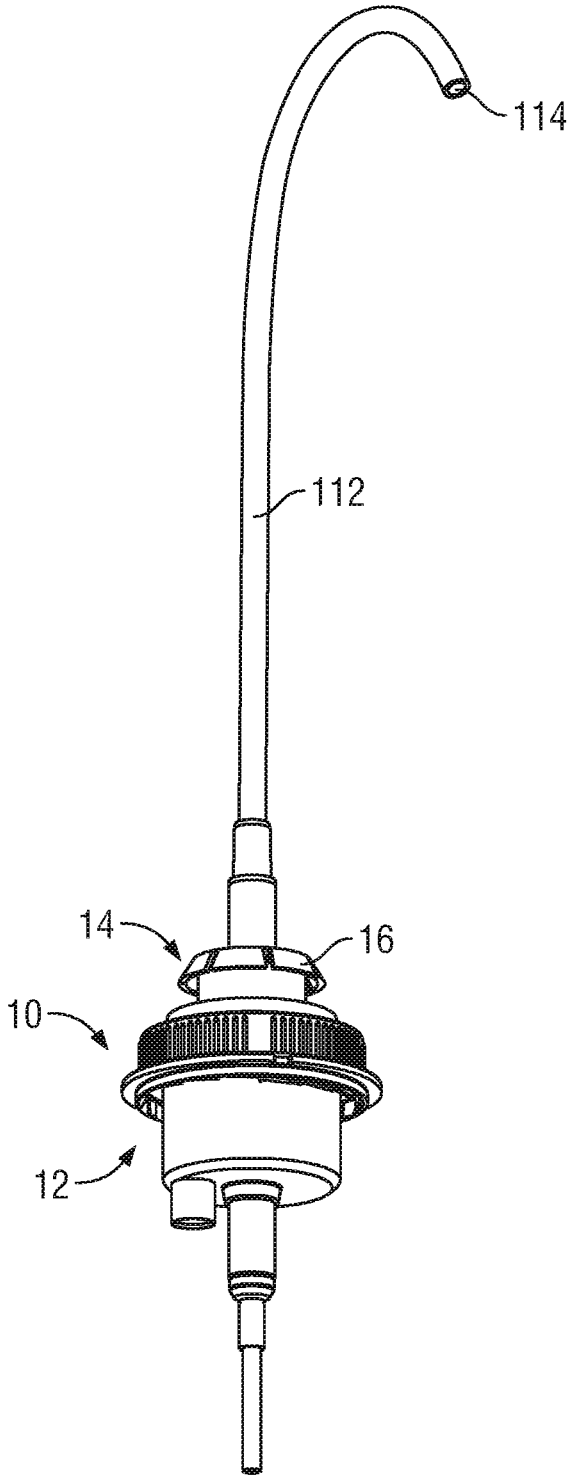
FIG. 11 is a pictorial view of a second embodiment of a pump assembly of the removable cartridge of FIG. 6 with a piston-forming element in a retracted position relative to a piston chamber-forming body.
Figure 12:
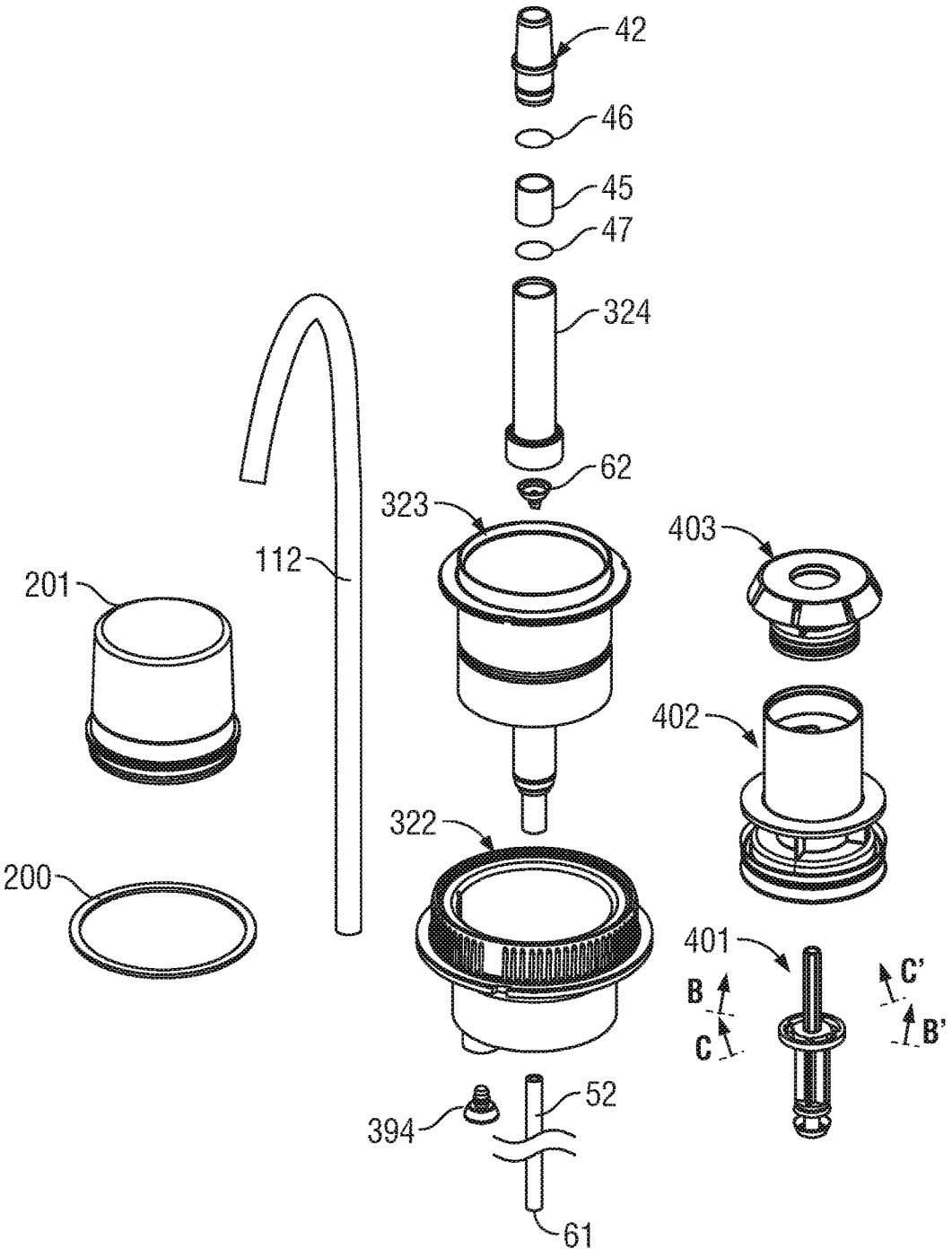
FIG. 12 is a pictorial exploded view of the pump assembly of FIG. 11 including, in addition, a removable cap.

In the liquid pump 78, there is defined between the outer disc 81 and the one-way inlet valve 62, as best seen in FIG. 9, a liquid compartment 85 with a volume that varies with the axial position of the fluid piston portion 79 within the fluid chamber 54.

With the piston-forming element 14 engaged on the piston chamber-forming body 12, as seen in FIGS. 8 and 9, the inner stem 64 extends axially outwardly to its inner stem outer end 66 located coaxially within inner tubular member 24 axially outwardly of the guide slots 36. As seen in FIGS. 8 and 9, an axially outwardly directed surface 86 of the inner stem 64 is opposed to an axially inwardly directed surface 87 of the inner tubular member 24 defining an annular space 88 therebetween. Preferably, the surface 86 of the inner stem 64 is located in close proximity to surface 87 of the inner tubular member 24 at least over an axial portion 166 of the inner stem 64 proximate the inner stem outer end 66 towards restricting flow axially through the annular space 88 to various extents as can be desirable.

The annular sealing member 70 has a radially outer seal member 89 engaging the outer tubular member 22 to prevent fluid flow inwardly and outwardly therebetween and a radially inner seal member 90 engaging the inner tubular member 24 axially outwardly of the guide slots 36 to prevent fluid flow inwardly and outwardly therebetween. The outer seal member 89 has an annular inner air disc 91 that, at its radially outer end, carries a pair of resilient disc arms 92 and 93. The inner seal member 90 has an annular outer air disc 94 and carries a resilient disc arm 95.

With the piston-forming element 14 engaged on the piston chamber-forming body 12 as seen in FIGS. 8 and 9:

(a) the inner air disc 91 extends radially outwardly with its disc arms 92 and 93 engaging the radially inwardly directed inner surface of the wall 48 of the outer tubular member 22 inside the air chamber 50 to provide a seal preventing flow axially inwardly and outwardly therepast; and (b) the outer air disc 90 extends radially inwardly with its disc arm 95 engaging a radially outwardly directed surface of the side wall 30 of the inner tubular member 24 axially outwardly of the guide slots 36 to provide a seal preventing flow axially outwardly therepast and to restrict flow axially inwardly therepast.

The annular sealing member 70 is coaxially slidably received in the annular air chamber 50 defining with the annular air chamber 50 an air pump 96 which, with reciprocal coaxial sliding of the piston-forming element 14 relative the piston chamber-forming body 12, draws air from the atmosphere into the air chamber 50 and discharges air from the air chamber 50 radially inwardly through the guide slots 36 into the central passage 32, wherein with reciprocal coaxial sliding of the piston-forming element 14 relative the piston chamber-forming body 12, liquid discharged by the liquid pump 78 is simultaneously discharged with air discharged by the air pump 96 through the central passage 32 and out the discharge tube 112 to the discharge outlet 114.

In a retraction stroke, the air pump 96 forces air from the air chamber 50 radially inwardly through the guide slots 36 simultaneously with the discharge of the liquid from the pump liquid 78 into the passageway 67 for simultaneous discharge of air and liquid into the central passage 32 and then through the foam generator 44 to produce foamed air and liquid that flows through the delivery tube 112 and out the discharge outlet 114. In a withdrawal stroke, the air pump 96 draws into the air chamber 50 foam, air or liquid within the central passage 32 and the delivery tube 112 as well as air from the atmosphere via the discharge outlet 114.

The air pump 96 includes a variable volume air compartment 97 defined between the annular sealing member 70 and the inner stem 64. As seen in FIGS. 8 and 9, the air compartment 97 includes an outer annular portion 98 and an inner annular portion 99 in communication with each other via the guide slots 36. The outer annular portion 98 is defined within the air chamber 50 axially inwardly and radially inwardly of the annular sealing member 70. The inner annular portion 99 is defined within the central passage 32 of the inner tubular member 24 radially outwardly of the inner stem 64 and axially outwardly of the fluid piston portion 79, that is, axially outwardly of the outer disc 81.

The air compartment 97 has a volume that varies with the axial position of the piston-forming element 14 within the piston chamber-forming body 12 whereby the air pump 96 is formed. In a retraction stroke, the volume of the air compartment 97 decreases forcing air (a) through the transfer ports 84 into the passageway 67 and (b) through the annular space 88 annularly about the axially outer end 66 of the inner stem 64 between inner stem 64 the inner tubular member 24, simultaneously with the discharge of the liquid from the pump liquid 78 into the central passage 32 providing for simultaneous discharge of air and liquid through the foam generator 44 to produce a foamed air and liquid mixture that flows through the delivery tube 112 and out the discharge outlet 114. In a withdrawal stroke, the volume of the air compartment 97 increases drawing foam, air or liquid within the central passage 32 and the delivery tube 112 as well as air from the atmosphere into the air compartment 97 via the discharge outlet 114. If a sufficiently high vacuum is created in the air compartment 97 in a withdrawal stroke, then air will be drawn from the atmosphere axially inwardly past resilient disc arm 95. The extent to which the resilient disc arm 95 is biased radially inwardly into engagement with the inner tubular member 24 will determine a minimum pressure differential between the pressure of atmospheric air on the axially outer side of the disc arm 95 and the pressure within the air compartment 97 at which the disc arm 95 will be deflected to permit atmospheric air to flow therepast into the air compartment 97 and function as a one-way air inlet valve, permitting atmospheric air adjacent to the piston chamber-forming body 12 to be drawn into the air chamber 50. In the first embodiment of the pump assembly of FIGS. 7 to 10, the inner seal member 90 is resilient and has an inherent bias biasing it into the side wall of the inner tubular member 24 to resist flow inwardly but to deflect against its inherent bias to permit air from the atmosphere to flow axially inwardly between the inner seal member 90 and the inner tubular member 24 when a sufficient pressure differential exists across the annular sealing member 790. In one preferred configuration under normal operating conditions, in the withdrawal stroke, both (a) foam, air and liquid within the central passage 32 and the delivery tube 112 are drawn back, and (b) atmospheric air is drawn into the air compartment 97 by deflection of the inner seal member 90. In another preferred configuration under normal operating conditions, the disc arm 95 engages the inner tubular member 24 to not permit flow axially inwardly therepast.

In the first embodiment of FIGS. 7 to 10, there are provided two transfer pathways for air to exit flow from the annular space 88 with the inner annular portion 99 of the air compartment 97 to the central passage 32 axially outwardly of the inner stem outer end 66. A first transfer pathway is: (a) through the transfer ports 84 into the passageway 67 and via the passageway 67 out the passageway outer end 69 into the central passage 32. A second transfer pathway is (b) through the annular space 88 annularly between the axially outer end 66 of the inner stem 64 and the inner tubular member 24. Only one of these two transfer pathways are necessary and, in the first embodiment, only one of the two pathways need be provided and the other may be eliminated or restricted. Where two such pathways are provided, the relative resistance of air flow through each may be suitably selected towards controlling the relative volume of air that is discharged through each in a retraction stroke as may be advantageous, for example, for mixing of the air and liquid before the foam generator 44 and/or in the foam generator 44. Providing the annular space 88 annularly between the axially outer end 66 of the inner stem 64 and the inner tubular member 24 can assist in coaxially locating the inner stem 64 within the inner tubular member 24, and reduce the sliding friction that could arise if compared to having the outer end 66 of the inner stem 64 to be engaged in a sealed relation within the inner tubular member 24 as to prevent all flow therebetween. As well, the injection of air through the annular space 88 to annularly about liquid simultaneously injected from the passageway 67 is advantageous for mixing of the injected air and liquid, particularly where the cross-sectional area of the annular space 88 is reduced to increase the velocity of the air injected. The annular space 88 either alone when providing the second transfer pathway or with the first transfer pathway provide a transfer passage through the central passage 32 axially outwardly of the liquid pump 78 providing communication from the guide slot 36 to outwardly of the inner stem outer end 66 permitting the air pump to discharge air from the air chamber 50 radially inwardly through the guide slot 36 and via the transfer passage to outwardly of the inner stem outer end 66.

As seen in FIGS. 8 and 9, about the inner stem end 65, the inner stem 64 is provided to have the axial portion 166 with an enlarged diameter to restrict the cross-sectional area of the annular space 88.

In the first embodiment, the reservoir bottle 104 is preferably a collapsible bottle which collapses as liquid is drawn from the bottle. If the bottle is a non-collapsible bottle, then the bottle is open to the atmosphere at its upper end, for example, directly or via a vacuum relief valve (not shown) permitting atmospheric air to enter the bottle when a vacuum condition is created in the bottle.

Reference is made to FIGS. 11 to 19 showing a second embodiment of a pump assembly 10 of FIG. 6. In describing the second embodiment, similar reference numerals are used to refer to similar elements in the first embodiment.

Figure 13:
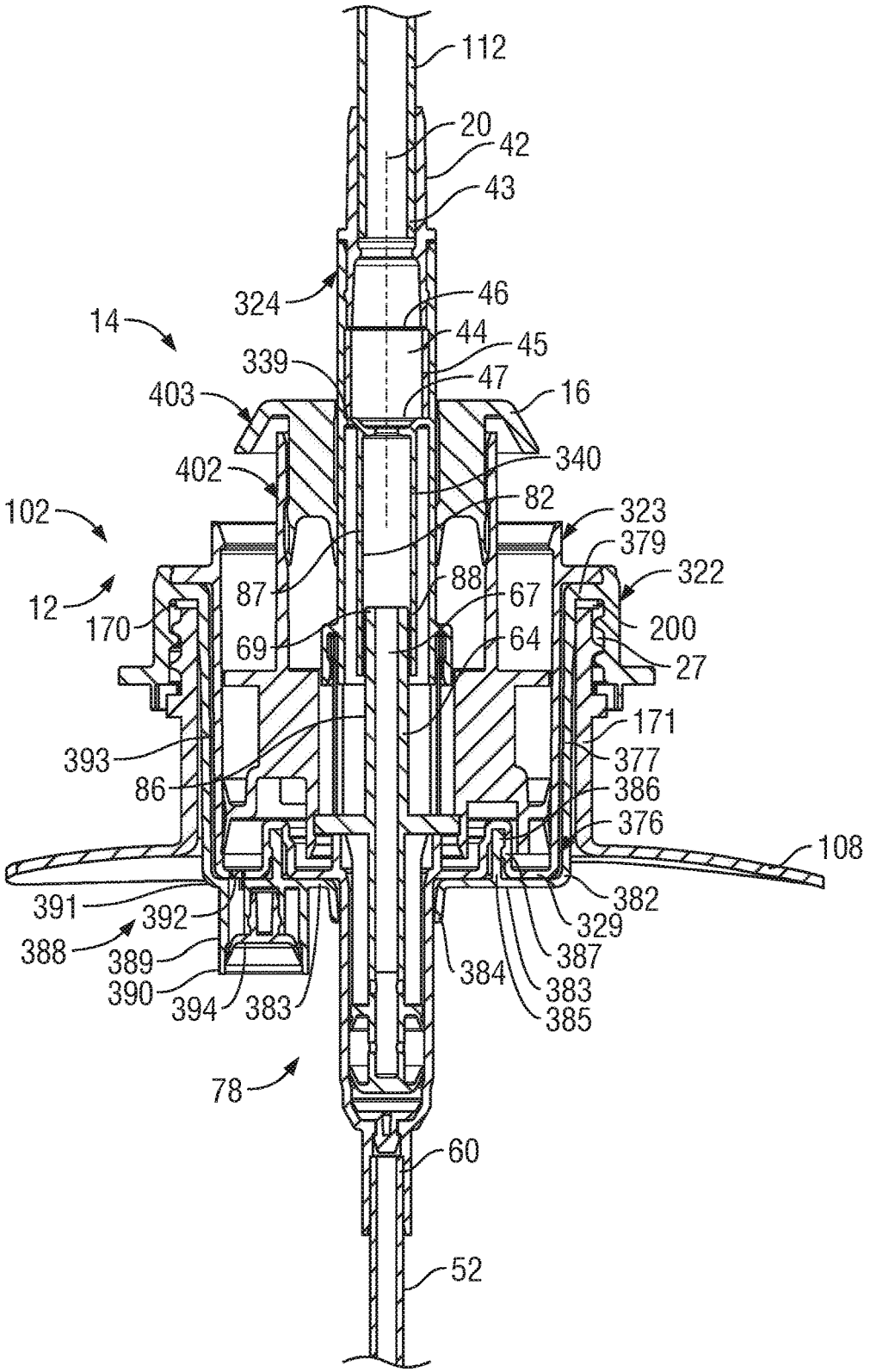
FIG. 13 is a cross-sectional view of the pump assembly of FIG. 11 along section line B-B' on FIG. 12 and additionally showing an upper portion of a bottle of the replaceable cartridge.
Figure 14:
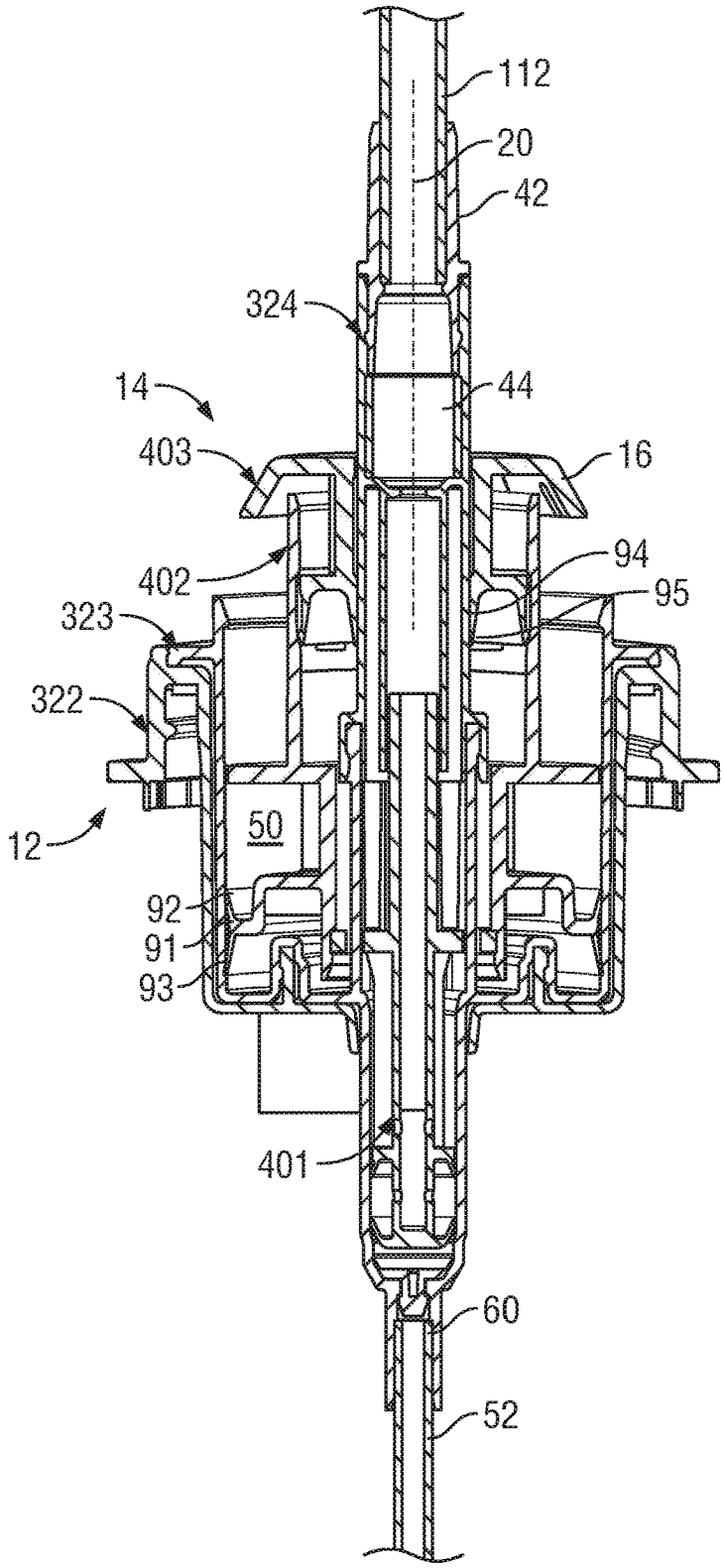
FIG. 14 is a cross-sectional side view of the pump assembly in the same retracted position as in FIG. 13, however, along section line C-C' on FIG. 12 rotated 45° relative to section line B-B' on FIG. 12.

As seen in the cross-section of FIG. 13, the pump assembly 10 has a piston chamber-forming body 12 and a piston-forming element 14. Each of the piston chamber-forming body 12 and the piston-forming element 14 is substantially disposed coaxially about a central axis 20. Coaxial reciprocal movement of the piston-forming element 14 relative the piston chamber-forming body 12 about the axis 20 between an axially retracted position as shown in FIGS. 13 and 14 and an axially extended position shown in FIG. 15, dispenses the liquid from the bottle 108 mixed with air from the atmosphere as a foam through the delivery tube 112.

Figure 16:
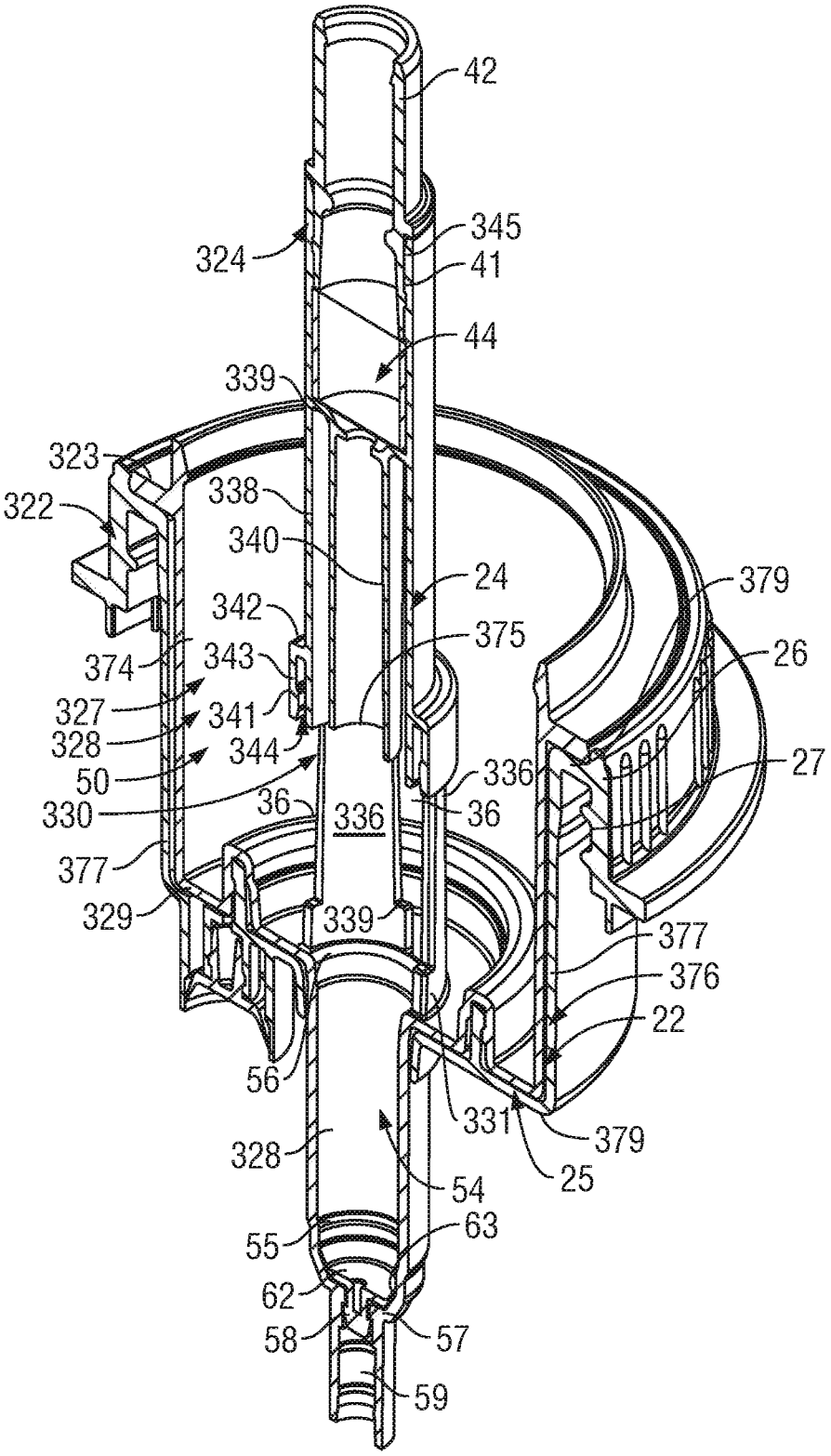
FIG. 16 is a pictorial cross-sectional side view along section line B-B' in FIG. 12 showing merely the piston chamber-forming body.

The piston chamber-forming body 12, as seen in FIG. 16, comprises three major components, a collar member 322, a chamber member 323 and a central take off or exit tube member 324 which are fixedly secured together in a snap-fit relation. In addition, as minor elements, the piston chamber-forming body 12 also includes a foam generator 44 and a one-way inlet valve 62.

The chamber member 323 has a side wall disposed coaxially about the axis 20 with a generally stepped configuration defining a tubular outer portion 327 and a tubular inner portion 328 connected by a radially extending shoulder 329. A slotted central support member 330 extends radially inwardly from the shoulder 329 with the support member 330 coupled to the shoulder 329 at an axial inner end 331 and extending axially outwardly to an outer distal end 332. The support member 330 is in the form of a cylindrical tube from which axially extending guide slots 36 have been cut. Each guide slot 36 is open axially outward at outer open end 334 at the distal end 332 of the support member 330 and extends axially inwardly to a blind end wall 339 axially inwardly toward the shoulder 329, defining between adjacent guide slots 36 circumferentially spaced axially extending guide finger members 336. Each finger member 336 carries at the distal end 332 a radially outwardly extending snap flange 337.

The central take off or exit tube member 324 has an outer tube member 338 joined by a radially inwardly extending inner shoulder 339 to an inner tube member 340. At an axially inner end 341 of the outer tube member 338, a radially outwardly extending outer shoulder 342 supports a socket tube member 343 forming an annular socket 344 open axially inwardly and adapted to receive the distal end 332 of the support member 330 with the finger members 336 and their snap flanges 337 engaged in a snap-fit relation in the annular socket 344 so as to fixedly couple the exit tube member 324 to the support member 330 of the chamber member 323 coaxially about the axis 20.

At an axially outer end 345 of the outer tube member 338, an annular socket 41 is provided open axially outwardly and adapted to receive in a snap-fit relation an inlet coupling 42 fixedly secured to an inlet end 43 of the delivery tube 114.

The foam generator 44 comprises a tubular spacer 45 and a pair of spaced screens 46 and 47 which are provided in the outer tube member 338 sandwiched axially between the inner shoulder 339 and the inlet coupling 42. The particular nature of the foam generator 44 is not limited. The purpose of the foam generator 44 is to generate a consistent mixture of a foamed air and liquid product on simultaneous passing of the air and liquid through the foam generator 44.

A fluid chamber 54 is defined within the tubular inner portion 328 radially inwardly of the wall of the chamber member 323 between an axially inner end 55 and an axially outer end. The fluid chamber 54 is circular in cross-section, substantially cylindrical and has a diameter. The axially inner end 55 of the fluid chamber 54 is defined by a radially inwardly extending shoulder 57 with an inlet opening 58 coaxially therethrough opening axially inwardly into a socket 59 open axially inwardly. The socket 59 is adapted to frictionally receive an inner end 60 of a hollow tubular dip tube 52. The dip tube 52 extends downwardly to a lower end 61 disposed approximate the bottom wall 174 of the bottle 108. A one-way inlet valve 62 is secured in the inlet opening 58 in a snap-fit and includes a resilient disc 63 that engages the radially inwardly directed inner surface of the wall to permit fluid flow axially outwardly therepast yet to prevent fluid flow axially inwardly therepast as in a manner, for example, described in a similar one-way inlet valve in U.S. Pat. No. 5,676,277 to Ophardt issued Oct. 14, 1997, the disclosure of which is incorporated herein by reference. The fluid chamber 54 is open at its axially outer end 56 into an inner end 371 of an air chamber 50.

The air chamber 50 is defined between its axially inner end 371 and its axially outer end 372 by the tubular outer portion 327 of the wall which is circular in cross-section, substantially cylindrical and has a diameter larger than the diameter of the tubular inner portion 328 forming the fluid chamber 54. The air chamber 50 is open axially outwardly at its axially outer end 372. The air chamber 50 includes an annular portion 374 annularly between the tubular outer portion 327 of the wall and the outer tube member 338 of the exit tube member 324 which annular portion 374 is open radially inwardly through the guide slots 36 in the support member 330 into the axially inner end of the central exit tube member 324 and notably the open axially inner end 375 of the inner tube member 340.

The collar member 322 has a side wall 376 disposed coaxially about the axis 20 with a tubular outer portion 377 carrying at its axially outer end 378 a radially outwardly extending outer shoulder flange 379 merging into an outer collar tube 26 having a threaded radially inwardly directed surface 27 carrying threads for engagement with complementary threads on the threaded neck 171 of the bottle 108. As can be seen in FIG. 13, the collar member 322 is secured to the bottle 108 with the threaded surface 27 of the collar member 322 engaging the threaded neck 171 on the bottle 108 and urging the outer shoulder flange 379 into sealed engagement with the opening 170 of the bottle 108, preferably with a resilient annular gasket member 200 disposed axially therebetween.

The tubular outer portion 377 of the side wall 376 of the collar member 322 carries at its axially inner end 382 a radially inwardly extending inner shoulder flange 383 merging into an open inner tube 384. The collar member 322 has on its shoulder flange 383 an axially outwardly extending coupling tube 385 that extends axially outwardly to a distal end 386.

An axially inwardly opening annular socket 387 is defined in the shoulder 329 of the chamber member 323 adapted to receive the axially outwardly extending coupling tube 385 on the chamber member 323 so as to fixedly secure together in a snap-fit the collar member 322 and the chamber member 323 coaxial about the axis 20.

A one-way air inlet valve 388 is provided on the inner shoulder flange 383 of the collar member 322 including an axially inwardly extending air inlet tube 389 open at one end 390 axially inwardly and open at an axially outer end 391 into an air inlet port 392 through the shoulder 329 of the chamber member 323. A resilient disc member 394 is secured within the air inlet tube 389 engaged therein to permit flow axially inwardly therethrough but to prevent flow axially outwardly therethrough.

As in the first embodiment, in the second embodiment, as seen on FIG. 16, the piston chamber-forming body 12 has an outer tubular member 22 and an inner tubular member 24 joined by an annular flange 25.

The outer tubular member 22 is formed by the outer tubular portion 327 of the chamber member 323 and the tubular outer portion 377 of the collar member 322. The inner tubular member 24 is formed by the tubular inner portion 328 and the slotted support member 330 of the chamber member 323 and the exit tube member 324. The annular flange 25 is formed by the shoulder 329 of the chamber member 323 and the shoulder flange 379 of the collar member 322.

Guide slots 36 are provided through the inner tubular member 24 as the guide slots 36 of the slotted support member 330.

Atmospheric air is permitted to flow into the bottle 108 via the one-way air inlet valve 388 when a vacuum created in the bottle 108 overcomes the bias of the disc member 392. The air inlet port 382 is in communication with atmospheric air via vent channels 393 axially between the collar member 322 and the chamber member 323 that permits atmospheric air to flow to inside the bottle 108 to relieve vacuum created by discharged liquid.

Figure 17:
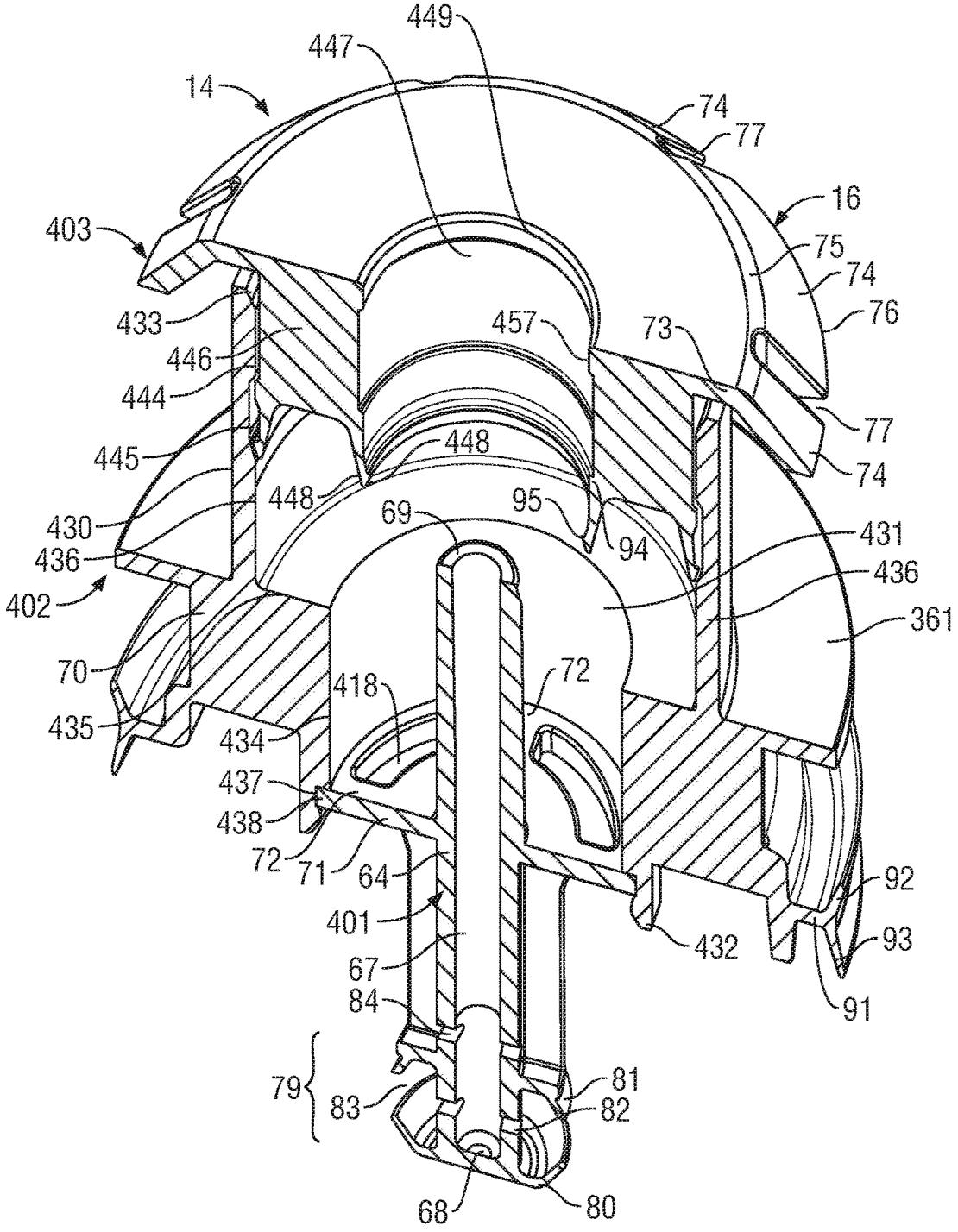
FIG. 17 is a pictorial cross-sectional view along section line B-B' in FIG. 12 showing merely the piston-forming body.
Figure 18:
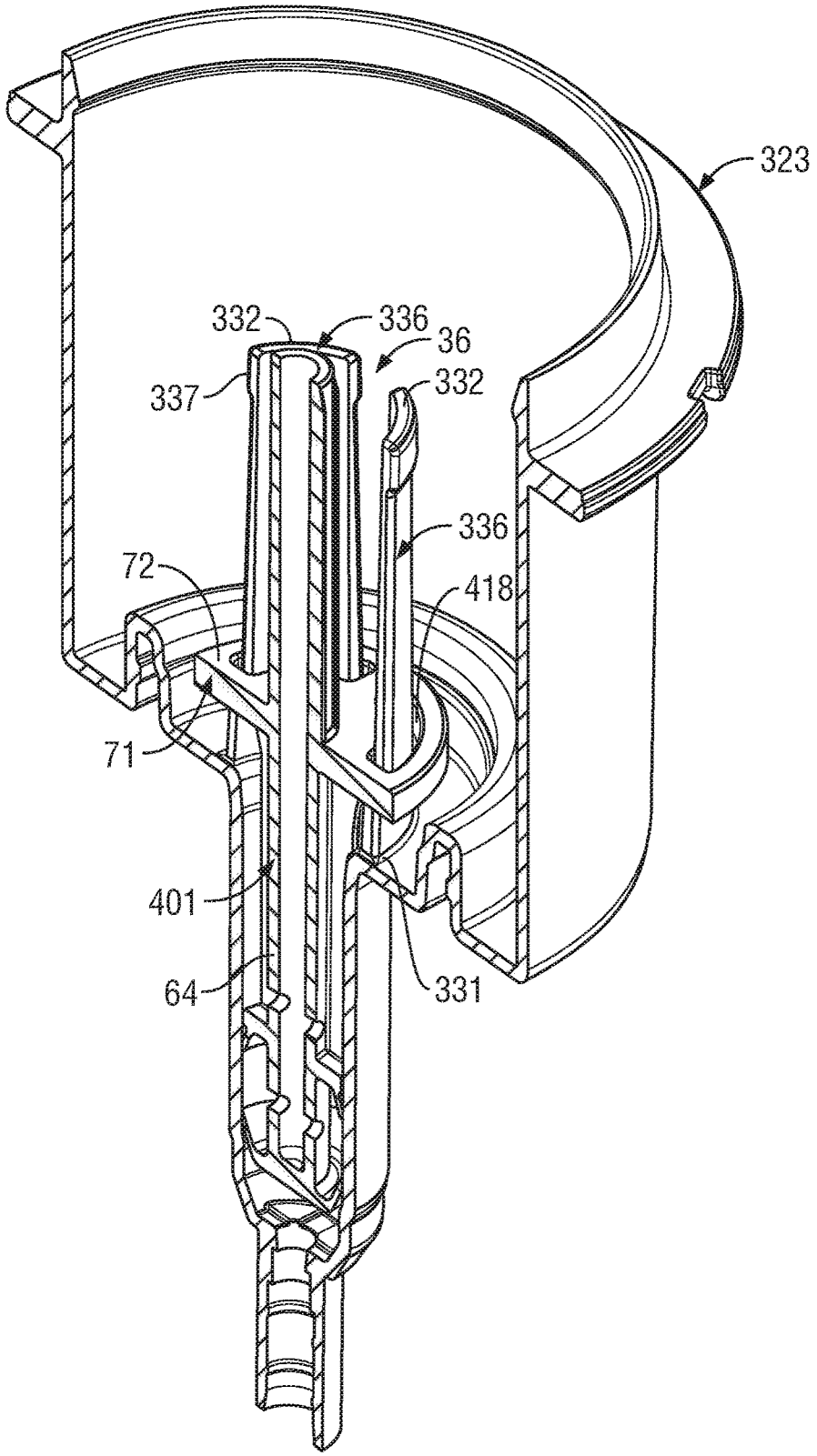
FIG. 18 is a pictorial cross-sectional view along section line B-B' in FIG. 12 illustrating a manner of axial sliding engagement of a liquid piston portion of the piston-forming element with a chamber member of the piston chamber-forming body.

Reference is made to FIG. 17 showing the piston-forming element 14 as formed from three major components fixedly coupled together, namely, a central piston portion 401, an annular outer piston portion 402 and an annular end member 403.

The piston-forming element 14 is generally coaxially about the axis 20.

The central piston portion 401 of the piston-forming element 14 includes a central axially extending inner stem 64 with a passageway 67 therethrough closed at an axially inner end 68 and open at an axially outer end 69. The central piston portion 401 carries a reduced diameter axially innermost fluid piston portion 79 which is adapted to be coaxially received within the fluid chamber 54 to form a liquid pump 78. The fluid piston portion 79 includes a resilient axially inner disc 80 that engages the tubular inner portion 328 of the wall 30 in the fluid chamber 54 to permit fluid flow axially outwardly therepast but to prevent fluid flow axially inwardly therepast. The fluid piston portion 79 includes an axially outer disc 81 that engages the wall 30 in the fluid chamber 54 to prevent fluid flow axially therepast. Liquid ports 82 located on the inner stem 64 between the outer disc 81 and the inner disc 80 extend coaxially through the stem 64 into the passageway 67. With reciprocal coaxial movement of the central piston portion 401 relative to the chamber member 323, the fluid is drawn upwardly from the bottle 108 though the dip tube 52 past the one-way inlet valve 62 into the fluid chamber 54 in a retraction stroke and in an opposite extension stroke, the fluid is discharged axially outwardly past the inner disc 80 into an annular space 83 radially outward of the inner stem 64 and radially inward of the wall 30 and between the inner disc 80 and the outer disc 81 and hence via the liquid ports 82 radially through the inner stem 64 into the passageway 67 leading to its axially outer end 69. The operation of the liquid pump 78 is substantially the same as described in U.S. Pat. No. 5,676,277 to Ophardt referenced above. However, many other configurations of a piston pump may be adopted for the liquid pump 78 without departing from the present invention.

In the liquid pump 78, there is defined between the outer disc 81 and the one-way inlet valve 62, a liquid compartment 85 with a volume that varies with the axial position of the central piston portion 401 within the fluid chamber 54.

Axially outwardly on the inner stem 64 from the outer disc 81, transfer ports 84 are provided radially through the inner stem 64 into the passageway 67. Axially outwardly from the transfer ports 84, a radially extending bridge flange member 71 extends radially outwardly. As best seen on FIG. 17, the bridge flange member 71 has axially extending guide openings 418 therethrough circumferentially spaced about the axis 20 by radially outwardly extending spoke members 72 of the bridge flange member 71. When the pump assembly 10 is assembled, the finger members 336 of the support member 330 of the chamber member 323 pass axially through the guide openings 418 with the spoke members 72 extending radially through the guide slots 36 of the support member 330, thus permitting as limited by the axial extent of the guide slots 36 the relative axial sliding of the piston-forming element 14 relative the piston chamber-forming body 12.

With the piston-forming element 14 engaged on the piston chamber-forming body 12, as seen in FIGS. 13 to 14, the inner stem 64 extends axially outwardly to its open axial outer end 69 located coaxially within the inner tube member 340 of the exit tube member 324. As seen in FIGS. 13 to 14, an axially outwardly directed surface 86 of the inner stem 64 is located in close proximity to an axially inwardly directed surface 87 of the inner tube member 340 towards restricting flow axially through an annular space 88 therebetween to extents desired.

As best seen on FIG. 17, the annular outer piston portion 402 includes an axially extending annular outer stem 430 with a central passageway 431 therethrough from an axially inner end 432 to an axially outer end 433. The central passageway 431 is stepped with a cylindrical axially inner portion 434 of a first diameter, a shoulder 435 and an axially outer portion 436 of a diameter greater than the first diameter. Proximate the inner end 432, a radially outwardly extending slotway 437 is provided in the wall of the inner portion 434 to securely receive a radially outer end 438 of the bridge flange member 71 to fixedly secure the annular outer piston portion 402 and the central piston portion 401. A tubular wall 439 is disposed annularly about the exit tube member between the exit tube member 324 and the outer portion of the wall 331.

An annular axially inner air disc 91 extends radially outwardly from the outer stem 430. The inner air disc 91 at its radially outer end carries a pair of resilient disc arms 92 and 93.

The axially outer end 433 of the outer portion 436 of the outer stem 430 is open axially outwardly as a central socket 444 with a snap groove 445.

The annular end member 403 has an annular tubular wall 446 defining a central passageway 447 axially therethrough from an axially inner end 448 to an axially outer end 449. At the outer end 449, an engagement flange 16 extends radially outwardly from the tubular wall 446 in the form of a circular disc 73 carrying a plurality of circumferentially spaced resilient finger members 74, each connected to the disc 73 at a first end 75 and extending radially outwardly and axially inwardly to a distal end 76. Adjacent finger members 74 are circumferentially spaced by radially and axially extending slots 77 through the disc 73.

The tubular wall 446 is engaged within the central socket 444 against removal with a radial stop flange 454 on a radially outwardly directed surface of the tubular wall 446 engaged in the slide groove 445 in the outer portion 436 to fixedly couple the annular end member 403 to the outer piston portion 402 yet permit limited relative coaxial sliding to create a drawback effect.

An annular axially outer air disc 94 is provided on the annular end member 403 extending radially inwardly into the central passageway 447 from a radially inwardly directed surface 457 of the annular tubular wall 446. The outer air disc 94 carries a resilient disc arm 95.

With the piston-forming element 14 engaged on the piston chamber-forming body 12 as seen in FIGS. 13 to 19:

(a) the inner air disc 91 extends radially outwardly with its disc arms 92 and 93 engaging the inner surface of the tubular outer portion 327 of the side wall of the chamber member 323 inside the air chamber 50 to provide a seal preventing flow axially inwardly and outwardly therepast; and (b) the outer air disc 94 extends radially inwardly with its disc arm 95 engaging a radially outwardly directed surface of the outer tube member 338 of the exit tube member 324 to provide a seal preventing flow axially outwardly therepast and resisting flow axially inwardly.

The engagement flange 16 is to be coupled and uncoupled with the actuator plate 140 on the dispenser housing 104 and is provided at an axial location on the piston chamber-forming body 12 axially outwardly of the piston chamber-forming body 12, such that the engagement member 16 can be engaged with and disengaged from the actuator plate 140 by relative radial movement.

As in the first embodiment, in the second embodiment, as seen in FIG. 17, the piston-forming element 14 has an annular sealing member 70 formed by the combination of the tubular wall 446 of the annular end member 403 carrying the outer air disc 94 and the outer stem 43 of the annular outer piston portion 402 carrying the inner air disc 91.

An air compartment 97 is defined between the inner stem 64, the outer stem 330 and the side wall of the chamber member 323 between the outer air disc 94, inner air disc 91 and the outer disc 81. The air compartment 97 includes an outer annular portion 98 and an inner annular portion 99 in communication with each other via the guide slots 36. The outer annular portion 98 is defined within the air chamber 50 axially inwardly and radially inwardly of the annular sealing member 70. The inner annular portion 99 is defined within the central passage 32 of the inner tubular member 24 radially outwardly of the inner stem 64 and axially outwardly of the fluid piston portion 79, that is, axially outwardly of the outer disc 81. The air compartment 97 has a volume that varies with the axial position of the piston-forming element 14 within the piston chamber-forming body 12 whereby an air pump 96 is formed. In a retraction stroke, the volume of the air compartment 97 decreases forcing air (a) through the transfer ports 84 into the passageway 67 and/or (b) through the annular opening 88 annularly about the axially outer end 66 of the inner stem 64 and the inner tube member 340 of the exit tube member 424 simultaneously with the discharge of the liquid from the pump liquid 78 into the passageway 67 for simultaneous discharge of air and liquid through the foam generator 44 to produce a foamed air and liquid that flows through the delivery tube 112 and out the discharge outlet 114. In a withdrawal stroke, the volume of the air compartment 97 increases drawing into the air compartment 97 foam, air or liquid within the passageway 67 and the delivery tube 112 as well as atmospheric air through the discharge outlet 114.

Figure 15:
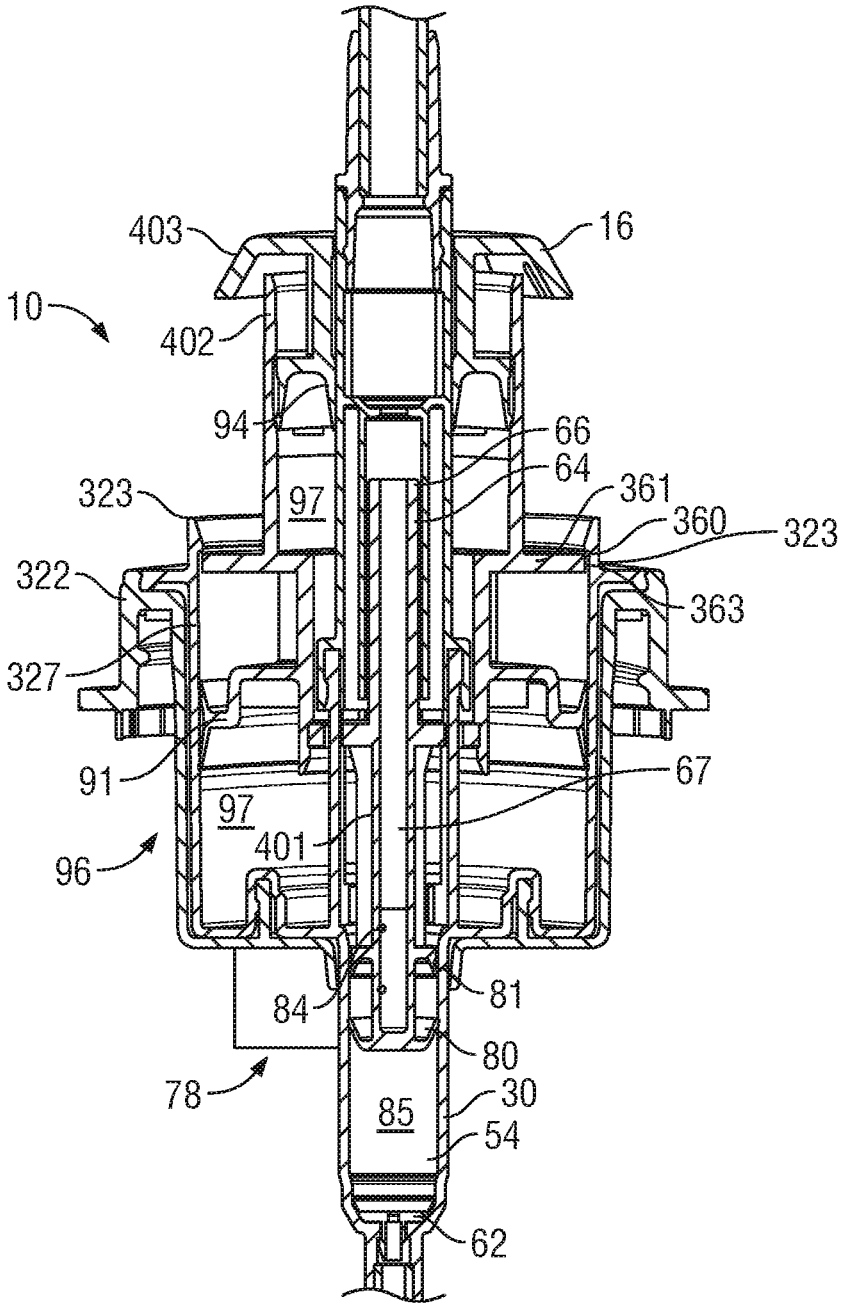
FIG. 15 is a cross-sectional side view the same as FIG. 14 along section line C-C' in FIG. 12, however, with the piston-forming element in an extended position relative to the piston chamber-forming body.

As can best be seen in FIG. 15, the engagement of an axially inwardly directed stop shoulder 360 on the chamber member 323 with axially outwardly directed surfaces on a radially extending guide flange 361 on the outer stem 430 of the outer piston portion 402 limits axial outward sliding of the piston-forming element 14 relative the piston chamber-forming body 12 in the extended position. The guide flange 361 extends radially outwardly to an end 363 in close relation to the radially inwardly directed surface of the tubular outer portion 327 of the side wall to assist in maintaining the piston-forming element 14 coaxial within the piston chamber-forming body 12.

The pump assembly 10 illustrated in the preferred embodiments provide for the simultaneous dispensing of air and liquid through a foam generator 44 to produce a foam product. The configurations of the pump assembly 10 is, however, also suitable for simultaneous dispensing of air and liquid as a spray or mist in which case the foam generator 44 would not be provided and a suitable nozzle for producing a desired spray of the air and the liquid would be provided preferably proximate the discharge outlet 114.

In each of the liquid pump 78 and air pump 96 shown, discharge is provided in a retraction stroke. The particular nature of the piston pumps illustrated by the liquid pumps 78 and the air pumps 96 may, however, be substituted by other constructions for liquid pumps and air piston pumps which may, for example, discharge fluid in a withdrawal stroke. However, it is to be appreciated that provision of the inner tubular member 24 and the exit tube member 324 as a fixed component of the piston chamber-forming body 12 can be adopted for various arrangements in which the piston-forming element 14 is to relatively slide axially relative to the piston chamber-forming body 12.

The preferred embodiments of the liquid pump 78 provide a separate one-way inlet valve 62. By the use, for example, of configurations of stepped chambers, a liquid piston pump can be provided without the need for a separate one-way valve.

In accordance with the present invention, the pump assembly 10 provides for simultaneous discharge of air and liquid in which the liquid pump 78 and the air pump 96 operate in sequence, that is, dispensing simultaneously in a retraction stroke. It is to be appreciated that various liquid pumps and air pumps may be utilized in which the liquid pump is out of phase with the air pump in the sense of the liquid pump discharges liquid into the air compartment during one stroke and the air pump discharges air and the liquid received from the liquid pump in an opposite stroke.

The preferred embodiments illustrates a pump assembly 10 in which each of the components forming the pump assembly are preferably formed as by injection molding from plastic materials and to provide for ease of manufacture from a minimal number of components. In FIGS. 11 to 19 the piston chamber-forming body 12 is shown as being illustrated principally from three components, namely, the central piston portion 401, the annular outer piston portion 402 and the annular end member 403. The three components could be injection molded as a single component as in the first embodiment of FIGS. 7 to 10 or as two or more components.

Figure 19:
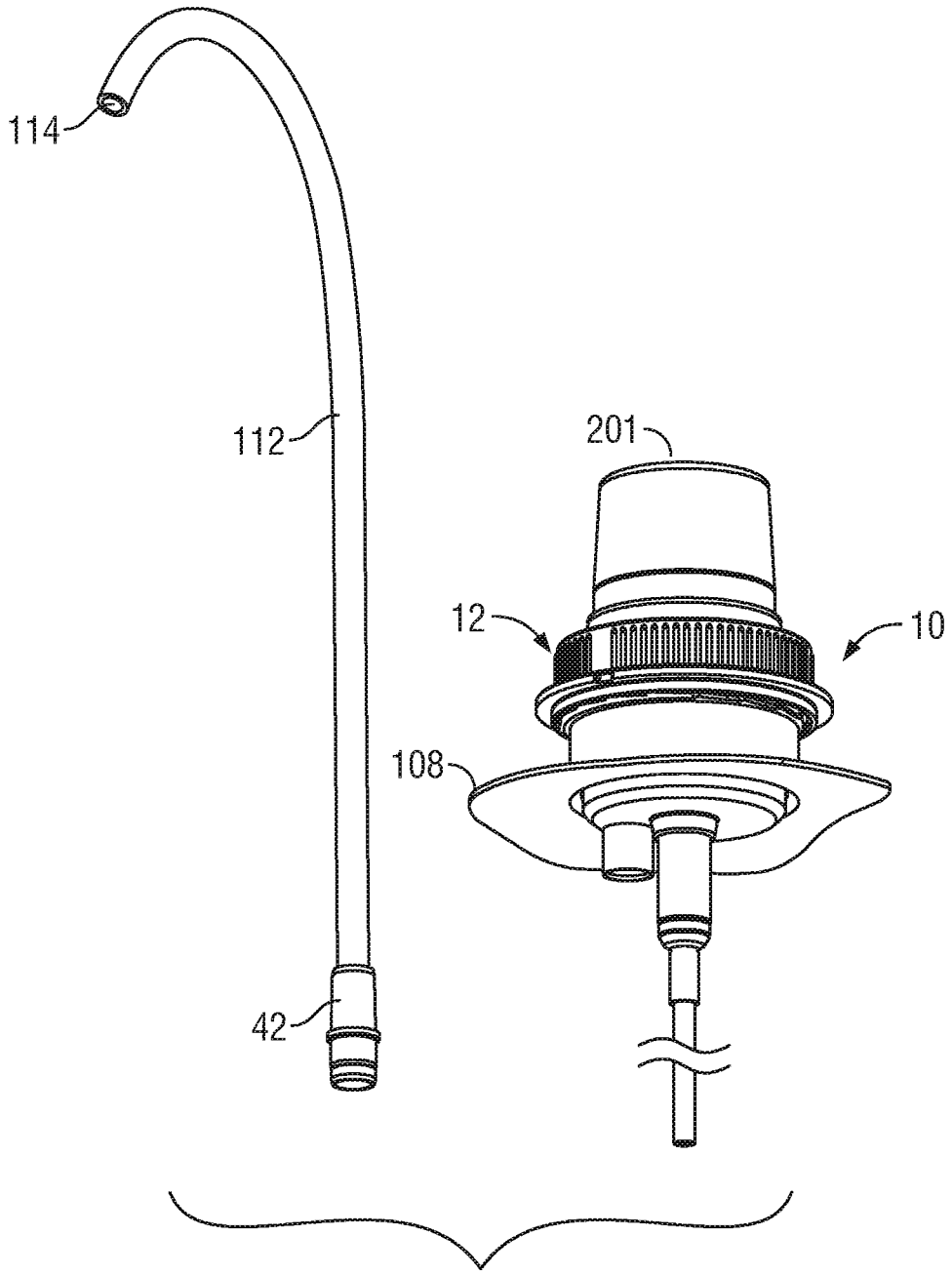
FIG. 19 is an exploded pictorial view illustrating the pump assembly of FIG. 12 with a discharge tube assembly shown separate from the remainder of an assembled pump assembly secured to an upper portion of the bottle and with the closure cap applied, as in a preferred condition for shipment of the replaceable cartridge.

FIG. 19 illustrates the pump assembly 10 configured for ease of shipment with the discharge tube 112 and inlet coupling 42 secured together separate from the pump assembly 10 which is schematically shown as having its piston chamber-forming body 12 coupled onto the bottle 108 and a closed cap 201 removably coupled to the piston chamber-forming body 12 to enclose and protect the axially outer end of the piston chamber-forming body 12 and the piston-forming element (not seen) carried in the piston chamber-forming body 12.

In accordance with the preferred embodiments, the pump assembly 10 is adapted for use in a dispenser assembly in which the liquid is dispensed upwardly from the bottle. This is not necessary and, in accordance with the present invention, pump assemblies could be developed which utilize similar arrangements for providing the inner tubular member 24 or the exit tube member 324 as a fixed component of the piston chamber-forming body 12 yet permit dispensing of the fluid downwardly or in other orientations such as horizontally.

While the invention has been described with reference to preferred embodiments, many modifications and variations will now occur to persons skilled in the art. For definition of the invention, reference is made to the follow claims.

We claim:

1. A pump for simultaneously dispensing liquid and air comprising:

a piston chamber-forming body disposed about a central axis, a piston-forming element received in the piston chamber-forming body coaxially slidable inwardly and outwardly therein between an outward extended position and an inward retracted position, the piston chamber-forming body having an inner tubular member extending axially between an axial inner end of the inner tubular member and an axially outer end of the inner tubular member, the inner tubular member having a circumferential side wall defining a central passage axially through the inner tubular member open both at the axial inner end of the inner tubular member and the axial outer end of the inner tubular member, the axially outer end of the inner tubular member open to a discharge outlet, the piston chamber-forming body having an outer tubular member extending axially between an axial inner end of the outer tubular member and an axially outer end of the outer tubular member, the outer tubular member disposed coaxially about the inner tubular member, the piston chamber-forming body having an annular flange fixedly connecting the outer tubular member to the inner tubular member, the annular flange extending radially inwardly from the outer tubular member to the inner tubular member closing the inner end of the outer tubular member, an annular air chamber defined annularly between the outer tubular member and the inner tubular member axially outwardly of the annular flange, the air chamber closed at an annular axially inner end of the air chamber by the annular flange and open axially outwardly through the axially outer end of the outer tubular member, at least one axially and circumferentially extending guide slot extending radially through the side wall of the inner tubular member between the air chamber and the central passage, the inner end of the inner tubular member in communication with liquid in a reservoir, a liquid chamber defined inside the inner tubular member axially inwardly of the guide slot, the piston-forming element having an axially extending tubular hollow inner stem extending between an axially inner stem inner end and an axially inner stem outer end, the inner stem having axially extending passageway therethrough closed at a passageway inner end and open at a passageway outer end through the inner stem outer end, the inner stem coaxially received within the inner tubular member for reciprocal coaxial sliding therein between the extended position and the retracted position with the inner stem inner end coaxially slidably received in the liquid chamber and the inner stem outer end coaxially slidably received in the inner tubular member axially outwardly of the guide slot, the piston-forming element having an annular sealing member coaxially slidably received in the air chamber spanning radially between the outer tubular member and the inner tubular member, the piston-forming element having at least one spoke member extending radially through the guide slot to fixedly couple the inner stem to the annular sealing member with the spoke member being axially slidable in the guide slot with coaxial sliding of the piston-forming element relative to the piston chamber-forming body between the extended position and the retracted position, the inner stem inner end carrying a fluid piston portion coaxially slidably received in the liquid chamber defining with the liquid chamber, a liquid pump which, with reciprocal coaxial sliding of the piston-forming element relative the piston chamber-forming body, draws the liquid from the reservoir and discharges the liquid into the passageway, axially outwardly through the passageway and out the passageway outer end into the central passage of the inner tubular member, the annular sealing member having a radially outer seal member engaging the outer tubular member to prevent fluid flow outwardly therebetween and a radially inner seal member engaging the inner tubular member axially outwardly of the guide slot to prevent fluid flow outwardly therebetween, the annular sealing member coaxially slidably received in the air chamber defining with the air chamber an air pump which, with reciprocal coaxial sliding of the piston-forming element relative the piston chamber-forming body, draws air from the atmosphere into the air chamber and discharges air from the air chamber radially inwardly through the guide slot to the central passage, wherein with reciprocal coaxial sliding of the piston-forming element relative the piston chamber-forming body, liquid discharged by the liquid pump and air discharged by the air pump are simultaneously passed through the central passage and out the discharge outlet.

2. A pump as claimed in claim 1 including a one-way air inlet valve to permit air from the atmosphere to be drawn into the air chamber by the air pump when the air pump creates across the one-way air inlet valve a sufficient vacuum below a pressure of the atmosphere air pressure.

3. A pump as claimed in claim 2 wherein the one-way air inlet valve permits air from the atmosphere adjacent to the piston chamber-forming body to be drawn into the air chamber by the air pump when the air pump creates across the one-way air inlet valve a sufficient vacuum below a pressure of the atmosphere air pressure.

4. A pump as claimed in claim 2 including a radial transfer port radially through the inner stem into the passageway axially outwardly of the liquid pump, wherein the air pump discharges air from the air chamber radially inwardly through the guide slot into the central passage about the inner stem open to the radial transfer port and hence through the radial transfer port into the passageway, then simultaneously with the fluid discharged by the liquid pump axially outwardly through the passageway and out the passageway outer end into the central passage of the inner tubular member axially outwardly of the inner stem outer end.

5. A pump as claimed in claim 1 including:

an annular space extending axially within the central passage radially between the inner stem and the side wall of the inner tubular member open to the guide slot, the annular space axially outwardly of the liquid pump and closed at an axial inner end by the fluid pump, a transfer pathway providing communication from the annular space to outwardly of the inner stem outer end, wherein the air pump discharges air from the air chamber radially inwardly through the guide slot into the annular space and via the transfer pathway to outwardly of the inner stem outer end.

6. A pump as claimed in claim 5 wherein:

the transfer pathway includes a first pathway provided by the annular space extending axially within the central passage radially between the inner stem and the side wall of the inner tubular member open to outwardly of the inner stem outer end of the inner stem, and the air pump discharges air from the air chamber radially inwardly through the guide slot into the annular space through the annular space to the central passage axially outwardly of the inner stem outer end, and then, simultaneously with the fluid discharged by the liquid pump from the passageway outer end, axially outwardly from the inner stem outer end through the central passage to the discharge outlet.

7. A pump as claimed in claim 6 wherein:

the transfer pathway includes a second pathway provided by a radial transfer port from the annular space radially through the inner stem into the passageway axially outwardly of the liquid pump, and the air pump discharges air from the air chamber radially inwardly through the guide slot into the annular space to the radial transfer port and hence through the radial transfer port into the passageway, and then simultaneously with the fluid discharged by the liquid pump axially outwardly through the passageway and out the passageway outer end to the central passage of the inner tubular member axially outwardly of the inner stem outer end.

8. A pump as claimed in claim 1 including:

a transfer passage provided through the central passage axially outwardly of the liquid pump, the transfer passage providing communication from the guide slot to outwardly of the inner stem outer end, wherein the air pump discharges air from the air chamber radially inwardly through the guide slot and via the transfer passage to outwardly of the inner stem outer end.

9. A pump as claimed in claim 7 wherein:

the annular space opens at an axially outer end into the central passage axially outwardly of the inner stem outer end, and the air pump discharges air from the air chamber radially inwardly through the guide slot into the annular space through the annular space to the central passage axially outwardly of the inner stem outer end, and then, simultaneously with the fluid discharged by the liquid pump from the passageway outer end, axially outwardly from the inner stem outer end through the central passage to the discharge outlet.

10. A pump as claimed in claim 1 wherein the liquid chamber is defined inside the inner tubular member proximate the inner end of the inner tubular member.

11. A pump as claimed in claim 1 wherein:

the piston-forming element having an engagement member adapted for engagement by an actuator for axial movement of the piston-forming element relative to the piston chamber-forming body.

12. A pump as claimed in claim 11 wherein:

the engagement member is carried on the annular sealing member.

13. A pump as claimed in claim 12 wherein:

the engagement member comprises an engagement flange extending radially outwardly from the inner stem axially outwardly of the outer tubular member.

14. A pump as claimed in claim 1 wherein:

the side wall of the inner tubular member having a radially inwardly directed inner surface and a radially outwardly directed outer surface, the outer tubular member having a circumferential side wall coaxially circumferentially there about with a radially inwardly directed inner surface, the radially outer seal member of the annular sealing member engaging the radially inwardly directed inner surface of the outer tubular member to prevent fluid flow inwardly and outwardly therebetween, and the radially inner seal member of the annular sealing member engaging radially outwardly directed outer surface of the inner tubular member axially outwardly of the guide slot to prevent fluid flow outwardly therebetween.

15. A pump as claimed in claim 14 wherein:

the radially inner seal member of the annular sealing member engaging the inner tubular member axially outwardly of the guide slot to prevent fluid flow both inwardly and outwardly therebetween.

16. A pump as claimed in claim 14 wherein:

the radially inner seal member of the annular sealing member engaging the inner tubular member axially outwardly of the guide slot to permit air from the atmosphere to flow inwardly therebetween into the air chamber when a sufficient pressure differential exists across the annular sealing member.

17. A pump as claimed in claim 1 wherein the radially inwardly directed inner surface of the outer tubular member having a diameter larger than a diameter of the radially outwardly directed outer surface of the inner tubular member.

18. A pump as claimed in claim 1 wherein the fluid piston portion including:

an inner disc on the inner stem extending radially outwardly from the inner stem engaging the radially inwardly directed side wall of the inner tubular member axially inwardly from the guide slot to prevent liquid flow axially outwardly between the inner disc and the inner tubular member but to permit fluid flow axially outwardly therebetween, an outer disc on the inner stem spaced axially outwardly from the inner disc and extending radially outwardly from the inner stem engaging the radially inwardly directed side wall of the inner tubular member to prevent liquid flow axially inwardly and outwardly therepast, a liquid port located on the inner stem between the inner disc and the outer disc providing communication through the inner stem into the passageway, and a one-way liquid inlet valve permitting liquid flow from the reservoir into the inner end of the inner tubular member and preventing flow from the inner end of the inner tubular member to the reservoir.

19. A pump as claimed in claim 14 wherein the fluid piston portion including:

an inner disc on the inner stem extending radially outwardly from the inner stem engaging the radially inwardly directed side wall of the inner tubular member axially inwardly from the guide slot to prevent liquid flow axially outwardly between the inner disc and the inner tubular member but to permit fluid flow axially outwardly therebetween, an outer disc on the inner stem spaced axially outwardly from the inner disc and extending radially outwardly from the inner stem engaging the radially inwardly directed side wall of the inner tubular member to prevent liquid flow axially inwardly and outwardly therepast, a liquid port located on the inner stem between the inner disc and the outer disc providing communication through the inner stem into the passageway, and a one-way liquid inlet valve permitting liquid flow from the reservoir into the inner end of the inner tubular member and preventing flow from the inner end of the inner tubular member to the reservoir.

20. A pump as claimed in claim 1 wherein the piston-forming element moving downwardly to slide inwardly relative the piston chamber-forming body and the piston-forming element moving upwardly to slide outwardly relative the piston chamber-forming body.

* * * * *